US010392706B2

(12) United States Patent
Hoshino et al.

(10) Patent No.: US 10,392,706 B2
(45) Date of Patent: Aug. 27, 2019

(54) GALVANIZED STEEL SHEET AND METHOD FOR PRODUCING THE SAME

(71) Applicant: JFE STEEL CORPORATION, Tokyo (JP)

(72) Inventors: Katsuya Hoshino, Columbus, OH (US); Shoichiro Taira, Tokyo (JP); Masayasu Nagoshi, Kawasaki (JP); Kazutoshi Hanada, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 246 days.

(21) Appl. No.: 15/121,589

(22) PCT Filed: Feb. 27, 2015

(86) PCT No.: PCT/JP2015/001053
§ 371 (c)(1),
(2) Date: Aug. 25, 2016

(87) PCT Pub. No.: WO2015/129282
PCT Pub. Date: Sep. 3, 2015

(65) Prior Publication Data

US 2016/0369406 A1 Dec. 22, 2016

(30) Foreign Application Priority Data

Feb. 27, 2014 (JP) ..... 2014-036380
Nov. 20, 2014 (JP) ..... 2014-235496

(51) Int. Cl.

| | |
|---|---|
| ***C23C 22/53*** | (2006.01) |
| ***C23C 22/50*** | (2006.01) |
| ***C23C 22/83*** | (2006.01) |
| ***C23C 2/06*** | (2006.01) |
| ***C23C 2/26*** | (2006.01) |
| ***C23C 2/40*** | (2006.01) |
| ***C23C 28/00*** | (2006.01) |
| ***C23C 22/62*** | (2006.01) |
| ***C23C 22/78*** | (2006.01) |

(52) U.S. Cl.
CPC ..... *C23C 22/50* (2013.01); *C23C 2/06* (2013.01); *C23C 2/26* (2013.01); *C23C 2/40* (2013.01); *C23C 22/53* (2013.01); *C23C 22/62* (2013.01); *C23C 22/78* (2013.01); *C23C 22/83* (2013.01); *C23C 28/3225* (2013.01); *C23C 28/345* (2013.01)

(58) Field of Classification Search
None
See application file for complete search history.

(56) References Cited

U.S. PATENT DOCUMENTS

| | | | |
|---|---|---|---|
| 2,915,444 | A | 12/1959 | Meyer |
| 9,175,414 | B2 | 11/2015 | Hoshino et al. |
| 2013/0260141 | A1 | 10/2013 | Hoshino et al. |

FOREIGN PATENT DOCUMENTS

| | | | |
|---|---|---|---|
| CN | 101437976 | A | 5/2009 |
| JP | 03191093 | | 8/1991 |
| JP | 08296017 | A | 11/1996 |
| JP | 2000073183 | A | 3/2000 |
| JP | 2002256448 | | 9/2002 |
| JP | 2003306781 | | 10/2003 |
| JP | 2004285468 | A | 10/2004 |
| JP | 2007016266 | | 1/2007 |
| JP | 2007016267 | | 1/2007 |
| JP | 2007119872 | | 5/2007 |
| JP | 2009127077 | | 6/2009 |
| JP | 2010077498 | A | 4/2010 |
| JP | 2010090464 | | 4/2010 |
| JP | 2010111894 | A | 5/2010 |
| WO | 2012043610 | A1 | 4/2012 |
| WO | 2015197430 | A1 | 12/2015 |

OTHER PUBLICATIONS

Machine Translation of Masuoka (JP 2007-016266), Jan. 25, 2007.*
Machine Translation of Nakajima (JP 2007-119872 A), May 17, 2007.*
Extended European Search Report for European Application No. 15755983.2, dated Oct. 20, 2017, 8 pages.
Korean Office Action for Korean Application No. 10-2016-7026479, including Concise Statement of Relevance of Office Action, dated Nov. 13, 2017, 4 pages.
International Search Report and Written Opinion for International Application No. PCT/JP2015/001053, dated May 26, 2015, 4 pages.
Japanese Office Action with partial English language translation for Application No. JP 2015-530230, dated Sep. 15, 2015, 5 pages.
Chinese Office Action for Chinese Application No. 201580010893.0, dated Jan. 31, 2018, including Concise Statement of Search Report, 8 pages.
Non Final Office Action for U.S. Appl. No. 15/122,036, dated Oct. 19, 2018, 15 pages.
Non Final Office Action for U.S. Appl. No. 15/526,140, dated Mar. 30, 2018, 9 pages.

* cited by examiner

*Primary Examiner* — Robert T Butcher
(74) *Attorney, Agent, or Firm* — RatnerPrestia

(57) ABSTRACT

A method for producing a galvanized steel sheet includes an oxide layer forming step of bringing a galvanized steel sheet into contact with an acidic solution containing sulfate ions, then holding the galvanized steel sheet in contact for 1 to 60 seconds, and then washing the galvanized steel sheet with water; and a neutralization treatment step of holding a surface of an oxide layer, which has been formed in the oxide layer forming step, in contact with an alkaline aqueous solution for 0.5 seconds or longer, and then performing washing with water and drying. The alkaline aqueous solution contains P ions at a P concentration of 0.01 g/L or more and carbonate ions at a carbonate ion concentration of 0.1 g/L or more.

20 Claims, 2 Drawing Sheets

GALVANIZED STEEL SHEET AND METHOD FOR PRODUCING THE SAME

CROSS-REFERENCE TO RELATED APPLICATIONS

This is the U.S. National Phase application of PCT/JP2015/001053, filed Feb. 27, 2015, and claims priority to Japanese Patent Application No. 2014-036380, filed Feb. 27, 2014, and Japanese Patent Application No. 2014-235496, filed Nov. 20, 2014, the disclosures of each of these applications being incorporated herein by reference in their entireties for all purposes.

FIELD OF THE INVENTION

The present invention relates to a galvanized steel sheet (zinc or zinc alloy coated steel sheet) that exhibits excellent slidability in press forming and excellent alkali degreasability in automobile manufacturing processes, and to a method for producing the galvanized steel sheet. Hereinafter, the term "galvanized steel sheet" is also used to describe a galvannealed steel sheet.

BACKGROUND OF THE INVENTION

Galvanized steel sheets are widely used in a wide range of fields, mainly, automobile body applications. In such applications, galvanized steel sheets are press-formed and painted before use.

However, galvanized steel sheets have a drawback in that they have poor press formability compared to cold-rolled steel sheets. This is because sliding resistance of galvanized steel sheets in press dies is larger than that of cold-rolled steel sheets. That is, a galvanized steel sheet does not smoothly flow into a press die at a portion where the sliding resistance between the die and the bead is large, and the steel sheet is likely to break.

A method of applying highly viscous lubricant oil has been widely employed as a method of improving press formability of galvanized steel sheets used. This method has a problem in that oil shortage during press forming results in instable press performance, for example. Accordingly, it is highly desirable to improve press formability of the galvanized steel sheets themselves.

In recent years, attempts have been made to simplify the production processes and reduce the amounts of substances of concern generated in the production processes. In particular, progress has been made on reducing the line length of the alkali degreasing process, which is a process that precedes a painting process, and decreasing the temperature of the working environment in the alkali degreasing process. Steel sheets that have excellent degreasability and do not adversely affect the painting process despite such severe conditions are in demand.

Accordingly, steel sheets that have excellent press formability as well as excellent degreasability under alkali degreasing conditions more stringent than in the related art are desirable as the galvanized steel sheets for automobiles.

One example of a method for improving press formability is a technique of forming a lubricant film or an oxide layer on a surface of a galvanized steel sheet.

Patent Literature 1 discloses a technique of improving press formability and chemical conversion ability by causing Ni oxides to occur on a surface of a zinc coated steel sheet by an electrolytic treatment, an immersion treatment, an application-oxidation treatment, or a heat treatment.

Patent Literatures 2 and 3 each disclose a technique of suppressing adhesion between a hot-dip galvannealed coating layer and a press die and improving slidability by causing a hot-dip galvannealed steel sheet to come into contact with a sulfuric acid acidic solution so that an oxide layer mainly composed of Zn oxide is formed on the steel sheet surface.

An example of the method for improving degreasability is to wash a steel sheet with an alkaline solution or a solution containing phosphorus (P).

Patent Literature 4 discloses a technique of improving degreasability by washing a surface of a hot-dip galvannealed steel sheet with an alkaline solution.

Patent Literature 5 discloses a technique of improving degreasability by washing a surface of a hot-dip galvannealed steel sheet with a solution containing P.

CITATION LIST

Patent Literature

Patent Literature 1: Japanese Unexamined Patent Application Publication No. 03-191093

Patent Literature 2: Japanese Unexamined Patent Application Publication No. 2002-256448

Patent Literature 3: Japanese Unexamined Patent Application Publication No. 2003-306781

Patent Literature 4: Japanese Unexamined Patent Application Publication No. 2007-016266

Patent Literature 5: Japanese Unexamined Patent Application Publication No. 2007-016267

SUMMARY OF THE INVENTION

However, according to Patent Literatures 1 to 3, although the lubricant and the like contained or the surface reaction layer exhibit a lubricating effect and lubrication is achieved between a press die and a galvanized steel sheet, the degreasability has not been good enough to satisfy required properties. According to Patent Literatures 4 and 5, a degreasability improving effect is exhibited, but this effect has not always been sufficient under stringent degreasing conditions.

The present invention has been made under the above-described circumstances. An object of the present invention is to provide a galvanized steel sheet that exhibits a low sliding resistance during press forming, exhibits excellent degreasability even under stringent alkali degreasing conditions that involve a low temperature and a short line length, suppresses dissolution of the oxide layer formed, and is capable of suppressing occurrence of unevenness due to a washing treatment, and to provide a method for producing the galvanized steel sheet.

The inventors of the present invention have conducted extensive studies to resolve the problems described above. As a result, they have found that sliding resistance during press forming is decreased, degreasability is excellent, dissolution of the oxide layer formed is suppressed, and unevenness caused by the washing treatment can be suppressed when the oxide layer formed on the surface of a steel sheet has the following features: After the oxide layer is neutralized by using an alkaline aqueous solution containing P ions at a P concentration of 0.01 g/L or more and carbonate ions at a carbonate ion concentration of 0.1 g/L or more, the oxygen intensity measured from the oxide layer and converted into a thickness as a $SiO_2$ film is 20 nm or more (equivalent to the thickness of the oxide layer); and the oxide layer contains Zn in an amount of 50 mg/m$^2$ or more, S in an amount of 5 mg/m$^2$ or more, C in an amount of 0.2 mg/m$^2$, P in an amount of 0.2 mg/m$^2$ or more. Thus, it has been found that the above-described problems can be resolved.

The present invention has been made based on the above-described finding and includes providing the following.

(1) A galvanized steel sheet including a steel sheet and a galvanized coating layer formed on the steel sheet, in which the coating layer includes an oxide layer in a surface layer, the oxide layer having an average thickness of 20 nm or more, and the oxide layer contains Zn, O, H, S, C, P, and unavoidable impurities, and contains 50 mg/m$^2$ or more of Zn, 5 mg/m$^2$ or more of S, 0.2 mg/m$^2$ or more of C, and 0.2 mg/m$^2$ or more of P.

(2) The galvanized steel sheet described in (1), in which a sulfate group, a carbonate group, a hydroxyl group, and a phosphate group exist in the oxide layer.

(3) The galvanized steel sheet described in (1) or (2), in which the oxide layer contains a crystal structure represented by $Zn_4(SO_4)_{1-X}(CO_3)_X(OH)_6.nH_2O$, where X is a real number in the range of $0<X<1$ and n is a real number in the range of $0\leq n\leq 10$.

(4) The galvanized steel sheet described in (1), (2), or (3), in which the oxide layer contains at least one selected from $PO_4^{3-}$, $P_2O_7^{4-}$, $P_3O_{10}^{5-}$, and an inorganic acid or a metal compound of any of the foregoing, and the metal compound contains at least one selected from sodium and zinc.

(5) The galvanized steel sheet described in any one of (1) to (4), in which the galvanized steel sheet is a hot-dip galvannealed steel sheet, a hot-dip galvanized steel sheet, or an electrogalvanized steel sheet.

(6) A method for producing the galvanized steel sheet according to any one of (1) to (5), the method including an oxide layer forming step of bringing a galvanized steel sheet into contact with an acidic solution containing sulfate ions, then holding the galvanized steel sheet in contact for 1 to 60 seconds, and then washing the galvanized steel sheet with water; and a neutralization treatment step of holding a surface of an oxide layer, which has been formed in the oxide layer forming step, in contact with an alkaline aqueous solution for 0.5 seconds or longer, and then performing washing with water and drying, in which the alkaline aqueous solution contains P ions at a P concentration of 0.01 g/L or more and carbonate ions at a carbonate ion concentration of 0.1 g/L or more.

(7) The method for producing the galvanized steel sheet described in (6), in which the alkaline aqueous solution contains a carbonate and at least one phosphorus compound selected from a phosphate, a pyrophosphate, and a triphosphate.

(8) The method for producing the galvanized steel sheet described in (6) or (7), in which the carbonate ions are contained at a carbonate ion concentration of 0.6 g/L or more.

(9) The method for producing the galvanized steel sheet described in any one of (6) to (8), in which the carbonate ions are contained at a carbonate ion concentration of 1.2 g/L or more.

(10) The method for producing the galvanized steel sheet described in any one of (6) to (9), in which the alkaline aqueous solution has a pH of 9 to 12 and a temperature of 20° C. to 70° C.

(11) The method for producing the galvanized steel sheet described in any one of (6) to (10), in which the acidic solution has a pH buffering action and has a pH-increasing property in the range of 0.003 to 0.5, where the pH-increasing property is defined by an amount (L) of a 1.0 mol/L sodium hydroxide solution needed to increase a pH of 1 L of the acidic solution from 2.0 to 5.0.

(12) The method for producing the galvanized steel sheet described in any one of (6) to (11), in which the acidic solution contains a total of 5 to 50 g/L of at least one salt selected from an acetate, a phthalate, a citrate, a succinate, a lactate, a tartrate, a borate, and a phosphate, and has a pH of 0.5 to 5.0 and a solution temperature of 20° C. to 70° C.

(13) The method for producing the galvanized steel sheet described in any one of (6) to (12), in which in the oxide layer forming step, an acidic solution coating weight on a steel sheet surface after contacting the acidic solution is 15 g/m$^2$ or less.

(14) The method for producing the galvanized steel sheet described in any one of (6) to (13), in which the galvanized steel sheet is a hot-dip galvannealed steel sheet, a hot-dip galvanized steel sheet, or an electrogalvanized steel sheet.

(15) The method for producing the galvanized steel sheet described in any one of (6) to (14), in which after a steel sheet is galvanized and before the oxide layer forming step, a surface is activated by being brought into contact with an alkaline aqueous solution.

(16) The method for producing the galvanized steel sheet described in any one of (6) to (15), in which after a steel sheet is galvanized and before the oxide layer forming step, temper rolling is performed.

The present invention provides a galvanized steel sheet that exhibits a low sliding resistance during press forming, exhibits excellent degreasability even under stringent alkali degreasing conditions that involve a low temperature and a short line length, suppresses dissolution of the oxide layer formed, and is capable of suppressing occurrence of unevenness due to a washing treatment.

DETAILED DESCRIPTION OF EMBODIMENTS OF THE INVENTION

Figure 1:
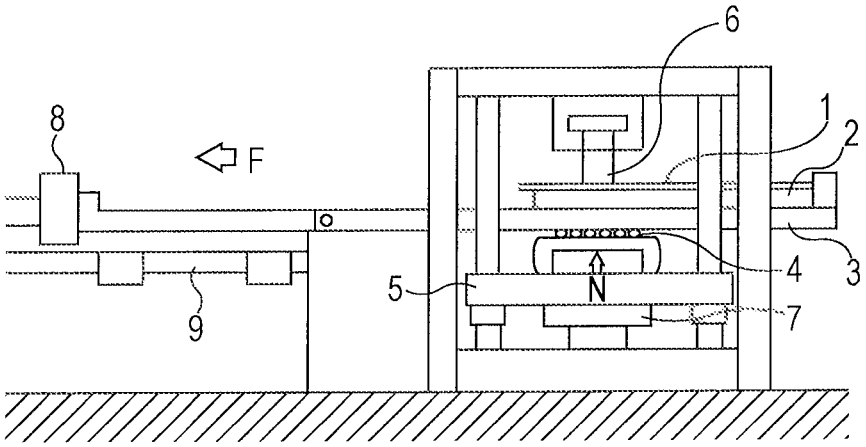
FIG. 1 is a schematic front view of a friction coefficient measuring instrument.

Embodiments of the present invention will now be described.

A method for producing a galvanized steel sheet according to an embodiment of the present invention is characterized in including an oxide layer forming step of bringing a galvanized steel sheet into contact with an acidic solution (sulfuric acid acidic solution) containing sulfate ions, holding the galvanized steel sheet in contact for 1 to 60 seconds, and washing the resulting steel sheet with water; and a neutralization treatment step of holding a surface of an oxide layer, which has been formed in the oxide layer forming step, in contact with an alkaline aqueous solution for 0.5 to 10 seconds, and performing washing with water and drying. The alkaline aqueous solution contains P ions at a P concentration of 0.01 g/L or more and carbonate ions at a carbonate ion concentration of 0.1 g/L or more. Each step is described below.

First, before the oxide layer forming step, galvanizing is conducted. The galvanizing method is not particularly limited. A prevailing method such as hot-dip galvanizing or electrogalvanizing can be employed. The treatment conditions for electrogalvanizing and hot-dip galvanizing are not particularly limited, and suitable conditions may be employed as needed. In conducting hot-dip galvanizing treatment, Al is preferably added to the hot-dip zinc bath from the viewpoint of dross management. In such a case, additive element components to the hot-dip zinc bath other than Al are not particularly limited. In other words, the effects of the present invention are not impaired even when elements such as Pb, Sb, Si, Sn, Mg, Mn, Ni, Ti, Li, and Cu are added or contained in addition to Al.

After hot-dip galvanizing, galvannealing may be conducted. For the purposes of the present invention, the conditions for galvannealing are not particularly limited and appropriate conditions may be employed as needed.

The steel sheet may be one subjected to galvanizing or one subjected to galvanizing and then galvannealing. The steel type of the steel sheet is not particularly limited. Various types of steel sheets, such as those made of low-carbon steel, ultralow-carbon steel, or IF steel, and high-tensile-strength steel sheets containing various alloying elements may be employed as the steel sheet. Both a hot rolled steel sheet and a cold-rolled steel sheet can be used as a base steel sheet.

When the steel sheet used in the present invention is a steel sheet that has been subjected to galvanizing and then galvannealing, i.e., when the steel sheet is a hot-dip galvannealed steel sheet, the area fraction of flat portions (top faces of protruding parts in the rough surface) in a surface of the hot-dip galvannealed coating layer is preferably 20% to 80%. At an area fraction less than 20%, the contact area between a press die and portions (recessed parts) other than the flat portions increases. This decreases the area fraction of the flat portions, in which the thickness of the oxide layer described below can be unfailingly controlled, relative to the area of the steel sheet that actually comes into contact with the press die. As a result, an effect on improving press formability is diminished. The portions other than the flat portions have a role of retaining press oil during press forming. Accordingly, if the area fraction of the flat portions exceeds 80%, oil shortage is likely to occur during press-forming of a hot-dip galvannealed steel sheet, and the effect of improving press formability is diminished.

The flat portions in the surface of the hot-dip galvannealed coating layer are easily identifiable by surface observation with an optical microscope, a scanning electron microscope, or the like. The area fraction of the flat portions in the surface of the hot-dip galvannealed coating layer can be determined by image-processing a photograph taken with the microscope.

In the present invention, temper rolling is preferably performed after galvanizing and before the oxide layer forming step. Temper rolling flattens the surface and moderates the surface roughness. As a result, during press forming, the force required for a die to press down protruding parts of the coating surface is decreased, and the sliding properties can be improved.

Specifically, the surface of the hot-dip galvannealed steel sheet has roughness due to the difference in reactivity between the steel sheet and the coating at the interface during galvannealing. It is important that the steel sheet be subjected to temper rolling in order to significantly enhance the slidability between the press die and the hot-dip galvannealed steel sheet produced by the production method of the present invention.

Furthermore, in the present invention, the surface is preferably activated by being brought into contact with an alkaline aqueous solution after galvanizing and before the oxide layer forming step. In particular, a typical hot-dip galvanized steel sheet or electrogalvanized steel sheet has an oxide layer (unnecessary oxide layer) as an outermost layer, the oxide layer having a thickness less than 10 nm and being formed of Zn or an impurity element, Al. Removing this unnecessary oxide layer with an alkaline aqueous solution can promote the oxide layer forming reaction in the subsequent oxide layer forming step and can shorten the time required for the production. The alkaline aqueous solution used in the activation treatment preferably has a pH in the range of 10 to 14. At a pH less than 10, the unnecessary oxide layer may not be completely removed. At a pH exceeding 14, dissolution of the galvanized coating layer is extensive, the surface is darkened, and burnt deposit may occur. The temperature of the alkaline aqueous solution used in the activation treatment is preferably in the range of 20° C. to 70° C. At a temperature lower than 20° C., it may require a long time to conduct reaction of removing the unnecessary oxide layer, and the productivity may be degraded. In contrast, at a temperature higher than 70° C., although the reaction may proceed relatively fast, burnt deposit and treatment unevenness are likely to occur on the steel sheet surface. Although the type of the solution is not particularly limited, a chemical such as NaOH is preferably used from the cost viewpoint. The alkaline aqueous solution may contain substances other than the elements contained in the zinc coating, such as Zn, Al, and Fe, and other components.

Next, the galvanized steel sheet is brought into contact with an acidic solution containing sulfuric acid (sulfuric acid present in the acidic solution is in a sulfate ion form and this solution may hereinafter be referred to as a "sulfuric acid acidic solution"), then held in contact for 1 to 60 seconds, and washed with water so as to form an oxide layer on the surface of the steel sheet. This oxide layer forming step is described below.

The exact mechanism behind formation of the oxide layer in the oxide layer forming step is not clear but can be presumed be as follows. When a steel sheet is brought into contact with a sulfuric acid acidic solution, dissolution of zinc occurs from the steel sheet. The dissolution of zinc induces hydrogen generating reaction at the same time. Thus, as dissolution of zinc proceeds, the hydrogen ion concentration in the solution decreases and the pH of the solution increases as a result, thereby forming an oxide layer mainly composed of Zn on the steel sheet surface.

The sulfuric acid acidic solution used in the oxide layer forming step may be any sulfuric acid acidic solution that has a pH at which zinc can be dissolved and an oxide layer can be formed (details are described below). Sulfuric acid is used to adjust pH. When sulfuric acid is used, the sulfuric acid acidic solution becomes an acidic solution that contains sulfate ions. The sulfate ion concentration in the sulfuric acid acidic solution is preferably 0.5 to 50 g/L. When the sulfate ion concentration is less than 0.5 g/L, the number of sulfate groups in the oxide is decreased, and the S content in the oxide layer becomes less than 5 mg/m$^2$. As a result, a crystal structure represented by $Zn_4(SO_4)_{1-X}(CO_3)_X$ $(OH)_6.nH_2O$ is rarely formed. A sulfate ion concentration is preferably not over 100 g/L since the cost rises, although no quality problem occurs.

In the present invention, a sulfuric acid acidic solution having a pH buffering action is preferably used among various sulfuric acid acidic solutions. A sulfuric acid acidic solution having a pH buffering action helps prevent an instantaneous increase in pH of the solution and helps form a sufficient amount of oxide layer compared to a sulfuric acid acidic solution that does not have a pH buffering action. When the sulfuric acid acidic solution used has a pH buffering action, an oxide layer having excellent slidability can be stably formed and thus the solution can contain metal ions, inorganic compounds, etc.

The pH buffering action of the sulfuric acid acidic solution can be evaluated in terms of the pH-increasing property defined by the amount (L) of a 1.0 mol/L aqueous sodium hydroxide solution needed to increase the pH of 1 L of the acidic solution to 2.0 to 5.0. In the present invention, this value is preferably in the range of 0.003 to 0.5. If the pH-increasing property is less than 0.003, the pH increases rapidly, a sufficient amount of zinc for forming of an oxide layer does not dissolve, and a sufficient amount of an oxide layer may not be formed. In contrast, when the pH-increasing property exceeds 0.5, dissolution of zinc is sometimes excessively promoted and it may take a long time to form an oxide layer; moreover, the coating layer may be severely damaged and the resulting steel sheet may no longer serve as an initially intended rustproof steel sheet. The pH-increasing property of an acidic solution having a pH exceeding 2.0 is evaluated by adding an inorganic acid, such as sulfuric acid, having substantially no buffering effect in the pH range of 2.0 to 5.0 is added to the sulfuric acid acidic solution so as to decrease pH to 2.0 for the time being.

Examples of the acidic solution having such a pH buffering action include solutions that contain acetates such as sodium acetate ($CH_3COONa$), phthalates such as potassium hydrogen phthalate ($(KOOC)C_6H_4(COOH)$), citrates such as sodium citrate ($Na_3C_6H_5O_2$) and potassium dihydrogen citrate ($KH_2C_6H_5O_2$), succinates such as sodium succinate ($Na_2C_4H_4O_4$), lactates such as sodium lactate ($CH_3CHOHCO_2Na$), tartrates such as sodium tartrate ($Na_2C_4H_4O_6$), borates, and phosphates. Preferably, at least one salt selected from these is contained in a total amount in the range of 5 to 50 g/L. If the amount is less than 5 g/L, the pH of the solution relatively rapidly increases with dissolution of zinc and thus an oxide layer capable of sufficiently improving slidability may not always be formed. At an amount exceeding 50 g/L, dissolution of zinc is accelerated, and not only it takes a long time to form an oxide layer but also the coating layer is severely damaged and the steel sheet may no longer serve as an initially intended rustproof steel sheet.

The sulfuric acid acidic solution preferably has a pH of 0.5 to 5.0. At a pH less than 0.5, dissolution of zinc is accelerated but an oxide layer is not smoothly formed. In contrast, when the pH exceeds 5.0, the reaction rate for zinc dissolution decreases.

The solution temperature of the sulfuric acid acidic solution is preferably 20° C. to 70° C. If the solution temperature is lower than 20° C., it may take a long time for the reaction of generating an oxide layer to complete and the productivity may be degraded. In contrast, at a temperature exceeding 70° C., the reaction proceeds relatively rapidly but treatment unevenness is likely to occur on the steel sheet surface.

The method for bringing the steel sheet into contact with the sulfuric acid acidic solution is not particularly limited. Examples thereof include a method of immersing the steel sheet in a sulfuric acid acidic solution, a method of spraying a sulfuric acid acidic solution onto the steel sheet, and a method of applying a sulfuric acid acidic solution to the steel sheet by using a coating roll. In the present invention, a sulfuric acid acidic solution film having a thin liquid film form is preferably present on a surface of the steel sheet at the final stage. This is because when the amount of the sulfuric acid acidic solution present on the steel sheet surface is large, the pH of the solution does not easily increase despite dissolution of zinc, and the possibility of sequential dissolution of zinc is assumed, sometimes taking a long time before formation of an oxide layer. When the amount of the sulfuric acid acidic solution present on the steel sheet surface is large, the hot-dip galvannealed coating layer may become severely damaged and the steel sheet may no longer serve as an initially intended rustproof steel sheet. From this viewpoint, the sulfuric acid acidic solution coating weight on the steel sheet surface after contacting the sulfuric acid acidic solution is preferably 15 $g/m^2$ or less. From the viewpoint of preventing the liquid film from drying, the coating weight is preferably 1 $g/m^2$ or more. The coating weight can be adjusted by using a squeeze roll, air-wiping, or the like. The coating weight of the sulfuric acid acidic solution can be measured with an infrared moisture gauge produced by CHINO CORPORATION.

After the galvanized steel sheet is brought into contact with the sulfuric acid acidic solution, the galvanized steel sheet is held in contact for 1 to 60 seconds.

In other words, the time taken until washing with water after contacting the acidic solution (the holding time until washing with water) needs to be 1 to 60 seconds. If the time until washing with water is less than 1 second, the sulfuric acid acidic solution is washed away before an oxide layer mainly formed of Zn is formed due to an increase in pH of the solution, and thus the slidability improving effect is no longer obtained. The amount of the oxide layer does not change if the time is longer than 60 seconds. This holding is preferably conducted in an atmosphere that has a higher oxygen content than atmospheric air in order to accelerate oxidation.

At the last stage of the oxide layer forming step, washing is performed with water. The method and conditions of the washing with water are not particularly limited. If washing with water is not performed, the salt having a pH buffering action present in the acidic treatment solution may inhibit the reaction with an alkaline aqueous solution containing carbonate ions and having pH of 9 to 12 in the subsequent neutralization treatment step. In particular, a sufficient amount of carbonate ions cannot be captured and there is a risk of degradation of degreasability and some of the sliding properties. Accordingly, it is preferable to conduct washing with water for 1 second or longer.

The portion that comes into contact with a press die during press forming is preferably formed of a substance that is hard and has a high melting point in order to prevent adhesion to the press die and improve slidability. The oxide layer formed in the oxide layer forming step is hard and has a high melting point. Accordingly, adhesion to the press die can be prevented and the sliding properties can be effectively improved. In particular, excellent slidability can be stably obtained when the flat portions of the surface of the temper-rolled steel sheet are subjected to a treatment that evenly forms an oxide layer.

During press forming, the oxide layer is worn and scraped as it comes into contact with the press die. Thus, the oxide layer must have a sufficient thickness without adversely affecting the effects of the present invention. The required thickness differs according to the degree of working by press forming. For example, a process which involves large deformation and a process which involves a large contact area between a press die and an oxide layer require thicker oxide layers. For example, the thickness of the oxide layer may be adjusted to be in the range of 20 to 200 nm. When the average thickness of the oxide layer is 20 nm or more, a galvanized steel sheet exhibiting excellent slidability is obtained. It is more effective to adjust the thickness of the oxide layer to 25 nm or more. This is because even when the oxide layer at the surface layer is worn out during a press forming process in which the contact area between a press die and a workpiece (galvanized steel sheet) is large, the oxide layer remains and slidability is rarely degraded. In contrast, the upper limit of the oxide layer is not particularly limited. However, when the oxide layer has a thickness larger than 200 nm, the reactivity of the surface decreases significantly, and a chemical conversion film may not be smoothly formed. Accordingly, the thickness of the oxide layer is preferably 200 nm or less. Specific adjustment of the thickness can be performed by appropriately changing the conditions for forming the oxide layer described below.

Next, the surface of the oxide layer formed in the oxide layer forming step is held in contact with an alkaline aqueous solution for 0.5 seconds of longer, and then washed with water and dried to conduct a neutralization treatment. This neutralization treatment step is described below.

The alkaline aqueous solution contains P ions at a P concentration of 0.01 g/L or more and carbonate ions at a carbonate ion concentration of 0.1 g/L or more. Because an alkaline aqueous solution containing P ions and carbonate ions is brought into contact with the oxide layer, it becomes possible to obtain excellent degreasability even under stringent alkali degreasing conditions that involve a low temperature, a short line length, and therefore a short treatment time. The low temperature here means that the temperature is 35° C. to 40° C. Short line length and short treatment time mean that the time is 60 to 90 seconds.

The degreasability improving mechanism is not exactly clear but can be presumed to be as follows. If the sulfuric acid acidic solution remains on the oxide layer surface after washing with water and drying, the amount of the surface etched increases, microscopic roughness is generated, and lipophilicity is enhanced. Washing with an alkaline aqueous solution and completely conducting neutralization prevent the sulfuric acid acidic solution from remaining on the surface. Moreover, since the alkaline aqueous solution contains P ions, P ions attach to the surface of the oxide layer formed. Since P ions are used in synthetic detergents and the like due to their cleansing action, P ions are considered to also contribute to degreasability under stringent alkali degreasing conditions. When carbonate ions are present, carbonate ions are captured within the oxide layer and change the crystal structure. At the same time, physical properties change, the lipophilicity is degraded, and degreasability is improved. Moreover, due to changes in physical properties, the dissolution reaction of the oxide layer due to P ions is weakened, and thus the amount of the oxide layer dissolved decreases significantly. At the same time, existing problems, such as appearance unevenness and degradation of press forming stability, caused by the difference in the oxide layer thickness caused by the reaction between the P ions and the oxide layer can be resolved.

The P ion concentration in the alkaline aqueous solution is 0.01 g/L or more in terms of P from the viewpoint of obtaining the effects of using the alkaline aqueous solution, i.e., in order for the P ions to attach to the surface of the oxide layer and contribute to degreasability. Preferably, the concentration is 0.1 g/L to 20 g/L in terms of P. At less than 0.01 g/L, a sufficient amount of P may not attach to the oxide layer. At a concentration exceeding 20 g/L, the oxide layer formed may dissolve.

The type of the phosphorus compound that supplies P ions to the alkaline aqueous solution is not particularly limited but the phosphorus compound is preferably at least one selected from a phosphate, a pyrophosphate, and a triphosphate from the viewpoints of cost and availability.

The carbonate ion concentration in the alkaline aqueous solution is preferably 0.1 g/L or more in terms of carbonate ions from the viewpoint of obtaining effects of using the carbonate ions, that is, in order to decrease lipophilicity, further improve degreasability, reduce the dissolution reaction of the oxide layer, prevent appearance unevenness, and stabilize press forming. At a concentration lower than 0.1 g/L, not enough carbonate ions are captured into the oxide layer and physical properties cannot be sufficiently changed. The concentration is preferably 0.6 g/L to 500 g/L. Considering the fluctuation of concentration during production, the carbonate ion concentration is more preferably 1.2 g/L or more. From the production cost viewpoint, the carbonate ion concentration is preferably 100 g/L or less.

There are no limitations regarding carbonate ions. Carbon dioxide may be blown in, or sodium carbonate, manganese carbonate, nickel carbonate, potassium carbonate, and their hydrates can be used. Use of carbon dioxide and carbonates listed above as examples is preferable from the viewpoints of cost and availability.

The pH of the alkaline aqueous solution is not particularly limited as long as the solution is alkaline but is preferably 9 to 12. The neutralization treatment can be satisfactorily conducted as long as the pH is 9 or more. Dissolution of the Zn coating layer can be easily prevented if pH is 12 or less.

The solution temperature of the alkaline aqueous solution is not particularly limited but is preferably 20° C. to 70° C. The reaction rate increases at a solution temperature of 20° C. or higher. Dissolution of the oxide film is reduced at a solution temperature of 70° C. or lower.

The method for bringing the alkaline aqueous solution into contact with the oxide layer is not particularly limited. Examples of the method include a method of immersing an oxide layer in an alkaline aqueous solution to achieve contact, a method of spraying an alkaline aqueous solution to achieve contact, and a method of coating an oxide layer with an alkaline aqueous solution by using a coating roll.

The time for which the alkaline aqueous solution is in contact with the oxide layer is 0.5 seconds or longer. When the time is set to 0.5 seconds or longer, excellent degreasability can be imparted to the galvanized steel sheet.

The configuration of the galvanized steel sheet according to embodiments of the present invention will now be described.

The oxide layer is composed of Zn, 0, H, S, C, P, and unavoidable impurities, and contains 50 $mg/m^2$ or more of Zn, 5 $mg/m^2$ or more of S, 0.2 $mg/m^2$ or more of C, and 0.2 $mg/m^2$ or more of P.

The Zn content needs to be 50 $mg/m^2$ or more and the S content needs to be 5 $mg/m^2$ or more from the viewpoint of slidability. The Zn content is preferably 1000 $mg/m^2$ or less and the S content is preferably 100 $mg/m^2$ or less from the viewpoints of weldability and chemical conversion ability. In order to adjust the Zn content and the S content to be in the above-described ranges, the production conditions are employed under which the zinc coated steel sheet is brought into contact with the sulfuric acid acidic treatment solution, held in contact for 1 to 60 seconds, and washed with water.

The P content needs to be 0.2 $mg/m^2$ or more from the viewpoint of degreasability. The P content is preferably 40 $mg/m^2$ or less from the viewpoints of weldability and chemical conversion ability. The C content needs to be 0.2 $mg/m^2$ or more from the viewpoints of degreasability, appearance unevenness, and stability of press forming. The C content is preferably 40 $mg/m^2$ or less from the viewpoints of weldability and chemical conversion ability. In order to adjust the P content and the C content within the above-described ranges, production conditions for bringing the zinc coated steel sheet into contact with the alkaline aqueous solution containing P ions and carbonate ions are employed.

The oxide layer contains H. The quantitative analysis of H is difficult. An X-ray photoelectron spectrometer can confirm presence of H through analysis of the existence form of Zn. When Zn is present as $Zn(OH)_2$ and narrow scan measurement of a spectrum corresponding to Zn LMM by using an Al Ka monochromatic source is conducted, a peak is observed near 987 eV. This confirms presence of H and OH groups. The H content is not particularly specified. Basically, H exists as OH and thus the H content is considered to increase with the increasing oxygen content.

A sulfate group, a carbonate group, a hydroxyl group, and a phosphate group preferably exist in the oxide layer from the viewpoint of film stability. When production conditions are employed under which the zinc coated steel sheet is brought into contact with the sulfuric acid acidic treatment solution, held in contact for 1 to 60 seconds, washed with water, and brought into contact with an alkaline aqueous solution containing carbonate ions, the oxide layer comes to contain a sulfate group, a carbonate group, and a hydroxyl group.

The oxide layer preferably contains a crystal structure represented by $Zn_4(SO_4)_{1-X}(CO_3)_X(OH)_6.nH_2O$. Here, X represents a real number in the range of $0<X<1$ and n represents a real number in the range of $0\leq n\leq 10$. When this crystal structure is contained, the effect of improving sliding properties due to slip deformation of the layered crystal is obtained. In particular, this contributes to improving the initial slip deformability and has a large influence on static friction coefficient and the like. In order to obtain these effects, the crystal structure content is preferably at a level that can be confirmed through the Examples described below. When production conditions are employed under which the zinc coated steel sheet is brought into contact with the sulfuric acid acidic treatment solution, held in contact for 1 to 60 seconds, washed with water, and brought into contact with an alkaline aqueous solution containing carbonate ions, the oxide layer comes to contain a crystal structure represented by $Zn_4(SO_4)_{1-X}(CO_3)_X(OH)_6.nH_2O$.

The oxide layer preferably contains at least one selected from $PO_4^{3-}$, $P_2O_7^{4-}$, $P_3O_{10}^{5-}$, inorganic acids of these (inorganic acids of $PO_4^{3-}$, $P_2O_7^{4-}$, and $P_3O_{10}^{5-}$), and metal compounds of these (metal compounds of $PO_4^{3-}$, $P_2O_7^{4-}$, and $P_3O_{10}^{5-}$) from the viewpoint of degreasability. Here, the metal compound is one that contains at least one selected from metal compounds $PO_4^{3-}$, $P_2O_7^{4-}$, and $P_3O_{10}^{5-}$, and one selected from hydrogen, sodium, and zinc. From the viewpoint of obtaining the effects described above, the content of this component is preferably at a level that can be confirmed through Examples described below. When production conditions are employed under which the zinc coated steel sheet is brought into contact with the sulfuric acid acidic treatment solution, held in contact for 1 to 60 seconds, washed with static friction coefficient and the like. In order to obtain these effects, the crystal structure content is preferably at a level that can be confirmed through Examples described below. When production conditions are employed under which the zinc coated steel sheet is brought into contact with the sulfuric acid acidic treatment solution, held in contact for 1 to 60 seconds, washed with water, and brought into contact with an alkaline aqueous solution containing carbonate ions, the oxide layer comes to contain a crystal structure represented by $Zn_4(SO_4)_{1-X}(CO_3)_X(OH)_6.nH_2O$. water, and brought into contact with an alkaline aqueous solution containing P ions, the oxide layer comes to contain at least one selected from $PO_4^{3-}$, $P_2O_7^{4-}$, $P_3O_{10}^{5-}$, and metal compounds of these.

The oxide layer may contain a metal oxide and/or hydroxide of elements other than Zn, and other components. The oxide layer may capture S, N, P, B, Cl, Na, Mn, Ca, Mg, Ba, Sr, Si, and the like due to impurities contained in the sulfuric acid acidic solution, but these elements can be contained as long as the effects of the present invention are not impaired.

The oxide layer is referred to as an "oxide layer" since an oxide presumably occurs during formation of the layer due to the above-describe mechanism; however, for the purposes of the present invention, the oxide content in the oxide layer is not particularly limited as long as the oxide layer satisfies the specified ranges of thickness, Zn content, etc.

The oxide layer formed according to the present invention can be analyzed by the methods described below.

The thickness of the oxide layer is measured by fluorescent X-ray analysis in which the obtained oxygen intensity is converted into a silica film thickness on the basis of the value of a silicon wafer having a silicon oxide film of a known thickness formed thereon.

The metal ions of Zn, S, P, and other metals contained in the oxide layer can be quantitatively determined by analyzing a solution, prepared by dissolving the oxide layer in an ammonium dichromate 2%/ammonia water 14% solution (% means % by mass), by using an ICP emission spectrometer. Regarding carbon (C) contained in the oxide layer, the film components can be extracted as powdered components by rubbing the surface of the oxide layer with a stainless steel brush having a diameter of 0.2 mm or less and a length of 40 mm or more and ethanol, and suction-filtering the obtained ethanol solution. The carbon content can then be determined by analyzing the extracted substance with a gas chromatograph mass spectrometer through a programmed temperature analysis.

The existence form of C can be analyzed by conducting gas chromatograph mass spectroscopy on a powdered oxide layer component prepared in the same manner.

Water of crystallization can be analyzed by analyzing the powdered oxide layer component, which is prepared in the same manner, with a differential thermogravimetric analyzer. The decrease in weight at 100° C. or lower corresponds to the water of crystallization. Water of crystallization refers to water molecules captured inside the crystal.

The existence forms of S, Zn, and O can be analyzed by an X-ray photoelectron spectrometer. The existence form of P can be analyzed by an X-ray absorption fine structure analyzer.

The crystal structure can be identified on the basis of the diffraction peaks of the oxide layer obtained in X-ray diffraction.

EXAMPLES

The embodiments reflected in the following Examples illustrate but do not limit the scope of the present invention.

Example 1

A cold-rolled steel sheet having a thickness of 0.7 mm was subjected to a hot-dip galvanizing treatment and a galvannealing treatment, and the resulting galvannealed sheet was temper rolled. Subsequently, an oxide layer forming treatment was performed in which the steel sheet was immersed in a sulfuric acid acidic solution controlled to the conditions shown in Table 1 (Table 1-1 and Table 1-2 are together referred to as Table 1), roll-squeezed, and then held for a particular time shown in Table 1. Then the resulting steel sheet was washed with water and dried. A neutralization treatment was then conducted under the conditions shown in Table 1.

The sulfate ion concentration was 15 g/L in Nos. 2 to 12, Nos. 23 to 49, and Nos. 57 to 62 in Table 1. The sulfate ion concentration was 0.5 to 30 g/L in Nos. 13 to 22 and 52 to 56. The hot-dip galvannealed steel sheet obtained as above was analyzed to determine the thickness of the oxide layer on the surface and evaluated in terms of press formability (sliding properties), degreasability, and appearance unevenness. The evaluation methods were as follows.

(1) Analysis of Oxide Layer

Analysis of Thickness of Oxide Layer

The thickness of the oxide layer was measured with a fluorescent X-ray analyzer. The voltage and the current of the tube bulb during measurement was 30 kV and 100 mA, respectively, the dispersive crystal was set to TAP, and the O—Kα line was detected. In measuring the O—Kα line, the intensity at the background position was measured in addition to the intensities at the peak positions so that the net intensity of the O—Kα line could be calculated. The integral time at each of the peak positions and background position was 20 seconds.

Silicon wafers, which had been cleaved into an appropriate size and had silicon oxide films 96 nm, 54 nm, and 24 nm in thickness respectively formed thereon, were placed on a sample stage along with a set of samples described above so that the intensity of the O—Kα line could be calculated from these silicon oxide films as well. The obtained data was used to plot calibration curves of the oxide layer thickness verses the O—Kα line intensity. The thickness of the oxide layer of the sample was then determined as the oxide layer thickness obtained by conversion on the basis of the silicon oxide films.

Compositional Analysis of Oxide Layer

Only the oxide layer was dissolved by using an ammonium dichromate 2%/ammonia water 14% solution (% means % by mass). The resulting solution was subjected to quantitative analysis for Zn, S, and P through ICP emission spectrometry.

The surface of the oxide layer was rubbed with a stainless steel brush having a diameter of 0.15 mm and a length of 45 mm and ethanol, and the obtained ethanol solution was suction-filtered to extract the film components as powdered components. The film components obtained as powder were subjected to programmed temperature analysis with a gas chromatograph mass spectrometer to quantitatively determine C. A pyrolysis oven was connected upstream of the gas chromatograph mass spectrometer. About 2 mg of the powdered sample taken was inserted into the pyrolysis oven, and the temperature of the pyrolysis oven was elevated from 30° C. to 500° C. at an elevation rate of 5° C./min. The gas generated in the pyrolysis oven was transported into a gas chromatograph mass spectrometer by using helium, and the gas composition was analyzed. The column temperature during the GC/MS measurement was set to 300° C.

Existence Form of C

The film components powdered and sampled in the same manner were analyzed with a gas chromatograph mass spectrometer so as to determine the existence form of C.

Existence Forms of Zn, S, O, and H

An X-ray photoelectron spectrometer was used to analyze the existence forms of S, Zn, and O. An Al Ka monochromic line source was used to conduct narrow scan measurement on spectra corresponding to Zn LMM and S 2p.

Existence Form of P

An X-ray absorption fine structure analyzer was used to analyze the existence form of P. The XAFS (*) was measured at room temperature with a beamline BL27A produced by High Energy Accelerator Research Organization, Photon Factory. A monochromated radiation was applied to the surface of a degreased sample, and the P-K shell absorption edge XANES (**) spectrum was measured by sample absorption current measurement through a total electron yield method (TEY).

*: X-ray Absorption Fine Structure

** X-ray Absorption Near-Edge Structure

Quantitative Determination of Water of Crystallization

A differential thermogravimetric analyzer was used to measure the decrease in weight at 100° C. or lower. About 15 mg of the powdered sample was used in the measurement. After the sample was introduced into the analyzer, the temperature was elevated from room temperature (about 25° C.) to 1,000° C. at a temperature elevating rate of 10° C./min, and the thermogravimetric changes during temperature elevation were recorded.

Identifying Crystal Structure

The film components powdered and sampled in the same manner were subjected to X-ray diffraction to predict the crystal structure. Cu was used as the target, and the measurement was conducted under the conditions of acceleration voltage: 40 kV, tube current: 50 mA, scan rate 4 deg/min, and scan range: 2° to 90°.

(2) Method for evaluating press formability (sliding properties)

Friction Coefficients of Each Sample were Measured as Below so as to Evaluate Press Formability.

(i) Dynamic Friction Coefficient Measurement Test: Drawn Parts and Inflow Parts are Targeted FIG. 1 is a schematic front view of a friction coefficient measurement instrument. As shown in this drawing, a sample 1 for measuring a friction coefficient taken from a sample material is fixed to a sample table 2, and the sample table 2 is fixed to an upper surface of a slide table 3 capable of horizontal movement. A slide table supporting stage 5 movable in vertical directions is disposed on the lower surface of the slide table 3, and has a roller 4 in contact with the slide table 3. A first load cell 7, which is configured to push up the slide table supporting stage 5 to measure the pressing load N of a bead 6 to the sample 1 for measuring a friction coefficient, is installed onto the slide table supporting stage 5. A second load cell 8, which is configured to measure sliding resistance force F required to move the slide table 3 in a horizontal direction while the pressing force is active, is installed at one end of the slide table 3. The test was conducted by applying a lubricant oil, which is Wash Oil for Press Forming PRETON R352L produced by Sugimura Chemical Industrial Co., Ltd., to a surface of the sample 1.

Figure 2:
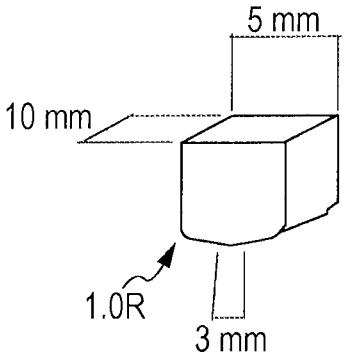
FIG. 2 is a schematic perspective view showing the shape and dimensions of a bead used in Condition 1 of Examples.
Figure 3:
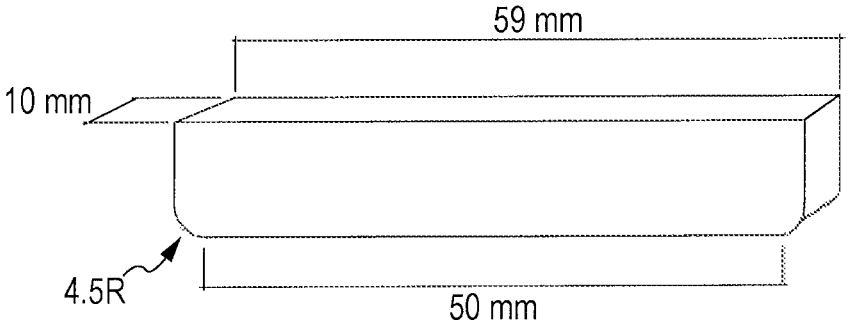
FIG. 3 is a schematic perspective view showing the shape and dimensions of a bead used in Condition 2 of Examples.

FIGS. 2 and 3 are schematic perspective views illustrating the shape and dimensions of the bead used. The slide table 3 slides while the lower surface of the bead 6 is being pressed against the surface of the sample 1. The shape of the bead 6 shown in FIG. 2 has a width of 10 mm, a length of 5 mm in a sliding direction of the sample, and a curvature of 1 mmR at curved surfaces at lower portions at two ends in the sliding direction. The bead lower surface to be pressed against the sample is a flat surface having a width of 10 mm and a length of 3 mm in the sliding direction. The shape of the bead 6 shown in FIG. 3 has a width of 10 mm, a length of 59 mm in the sliding direction of the sample, and a curvature of 4.5 mmR at curved surfaces at lower portions at two ends in the sliding direction. The bead lower surface to be pressed against the sample is a flat surface having a width of 10 mm and a length of 50 mm in the sliding direction.

The friction coefficient measurement test was conducted under the following two conditions:

[Condition 1]

The bead shown in FIG. 2 was used. Pressing load N: 400 kgf; sample pull-out rate (horizontal movement speed of slide table 3): 100 cm/min.

[Condition 2]

The bead shown in FIG. 3 was used. Pressing load N: 400 kgf; sample pull-out rate (horizontal movement speed of slide table 3): 20 cm/min.

The friction coefficient μ between the sample material and the bead was calculated from the formula: μ=F/N.

Figure 4:
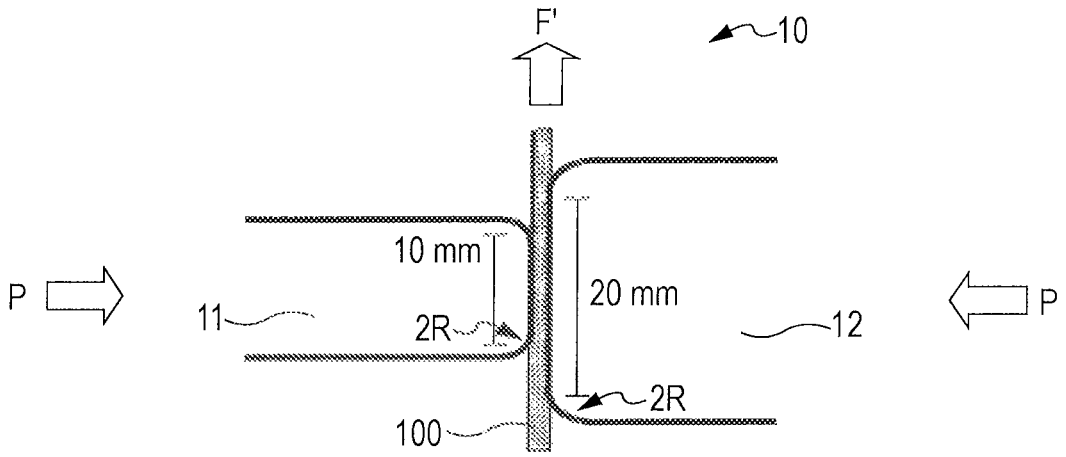
FIG. 4 is a schematic perspective view showing the shape and dimensions of a bead used in Condition 3 of Examples.

(ii) Static Friction Coefficient Measurement Test: Stretch-Formed Parts were Targeted A press-forming simulation clarified that the static friction coefficient has a higher relevancy with the actual press formability than the dynamic friction coefficient for parts that have a contact pressure of 7 MPa or less and a sliding speed of 50 mm/min or less (such as stretch-formed parts). In order to evaluate press formability (in particular, formability of the stretch formed parts), the static friction coefficient of each sample material was measured as follows. FIG. 4 is a schematic view of a static friction coefficient measurement instrument that uses a tester 10. As illustrated in this drawing, a sample 100 for measuring static friction coefficient taken from a sample material was pressed against dies 11 and 12 at a constant load P of 370 kgf. Then the sample 100 held between the dies 11 and 12 were pulled out at a speed of 10 mm/min. With this procedure, the constant load P and the load F' required to pulled out the sample 100 were measured at an interval of 0.005 Hz. The static friction coefficient μ was calculated from the formula: α=F'/P, and the friction coefficient of the peak value after start of sliding was acquired as the static friction coefficient. The shape of the die 11 had a width of 35 mm, a length of 14 mm in the sliding direction of the sample, and a curvature of 2 mmR at curved surfaces at lower portions at two ends in the sliding direction. The bead lower surface to be pressed against the sample was a flat surface having a width of 35 mm and a length of 10 mm in the sliding direction. The shape of the die 12 had a width of 35 mm, a length of 24 mm in the sliding direction of the sample, and a curvature of 2 mmR at curved surfaces at lower portions at two ends in the sliding direction. The bead lower surface to be pressed against the sample was a flat surface having a width of 35 mm and a length of 20 mm in the sliding direction (referred to as Condition 3 hereinafter). The test was conducted by applying a lubricant oil, which is Wash Oil for Press Forming PRETON (registered trademark) R352L produced by Sugimura Chemical Industrial Co., Ltd., to a surface of the sample 100.

(3) Method for Evaluating Degreasability

Degreasability was evaluated on the basis of wetting ratio after degreasing. Wash Oil for Press Forming PRETON R352L produced by Sugimura Chemical Industrial Co., Ltd., was applied to the prepared test piece at a coating weight of 2.0 g/m$^2$ per side, and the sample was degreased with an alkali degreasing solution, FC-L4460 produced by NIHON PARKERIZING CO., LTD. To the degreasing solution, 10 g/L of Wash Oil for Press Forming PRETON R352L produced by Sugimura Chemical Industrial Co., Ltd., was added in advance so as to simulate deterioration of the alkali degreasing solution in automobile manufacturing lines. The degreasing time was set to 60 seconds and the temperature was set to 37° C. During degreasing, the degreasing solution was stirred at a rate of 150 rpm with a propeller having a diameter of 10 cm. The wetting ratio of the test piece was measured 20 seconds after completion of degreasing so as to evaluate degreasability.

(4) Evaluation of Appearance Unevenness

Figure 5:
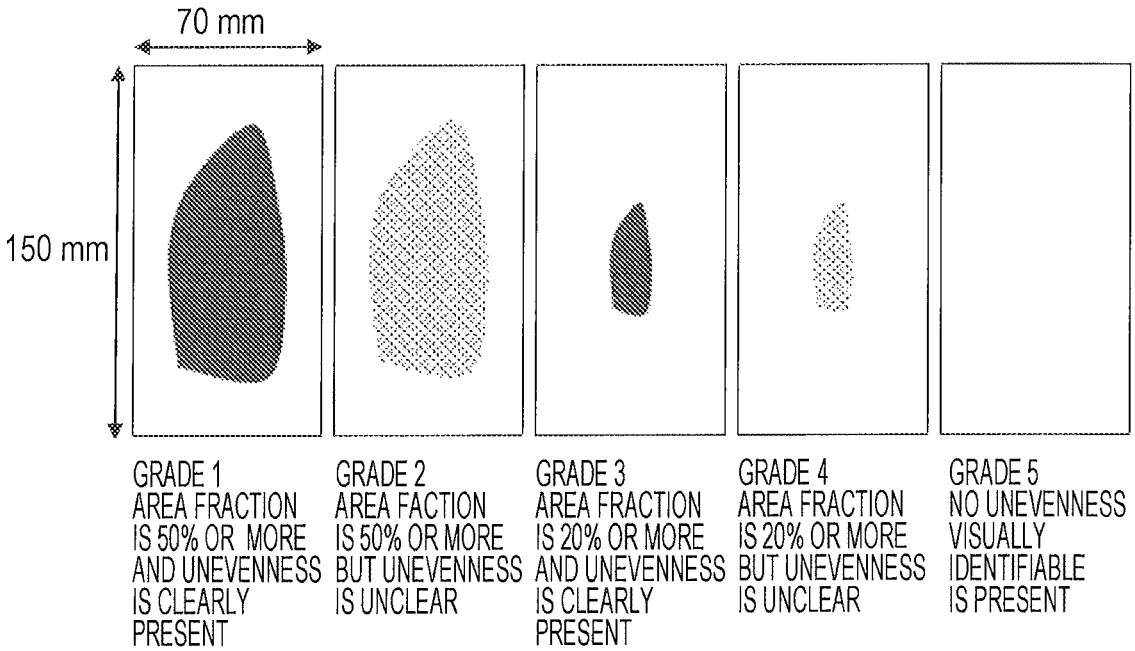
FIG. 5 is a diagram indicating evaluation criteria for evaluating appearance unevenness.

The appearance unevenness was visually evaluated. The appearance samples shown in FIG. 5 were used as the criteria and evaluation was given from Grade 1 to Grade 5. Samples rated Grade 4 or higher are considered excellent, and samples rated Grade 5 are considered more excellent.

The results obtained as above are shown in Table 2 (Table 2-1 and Table 2-2 are together referred to as Table 2).

TABLE 1

| | Oxide layer forming treatment | | | | | | | | | Neutralization treatment Alkaline aqueous solution |
|---|---|---|---|---|---|---|---|---|---|---|
| | Acidic solution | | | | | | | | | |
| | pH Buffer | | pH Adjustor | | | | | | | |
| No. | Type of chemical | Concentration (g/L) | Type of chemical | pH | pH-increasing property | Temperature (° C.) | Coating weight of acidic solution film (g/m$^2$) | Holding time (sec) | Washing with water | Phosphorus compound Type of chemical |
| 1 | No treatment | — | — | — | — | — | — | — | — | No treatment |
| 2 | Sodium | 30 | Sulfuric | 1.5 | 0.20 | 35 | 5 | 10 | Yes | None |
| 3 | acetate•Trihydrate | | acid | | | | | 3 | | Sodium |
| 4 | | | | | | | | 5 | | pyrophosphate |
| 5 | | | | | | | | 10 | | |
| 6 | | | | | | | | 30 | | |
| 7 | | | | | | | | 60 | | |
| 8 | Sodium | 30 | Sulfuric | 1.5 | 0.20 | 35 | 5 | 3 | Yes | Sodium |
| 9 | acetate•Trihydrate | | acid | | | | | 5 | | pyrophosphate |

TABLE 1-continued

| | | | | | | | | | | |
|---|---|---|---|---|---|---|---|---|---|---|
| 10 | | | | | | | | 10 | | |
| 11 | | | | | | | | 30 | | |
| 12 | | | | | | | | 60 | | |
| 13 | Sodium | 30 | Sulfuric | 0.8 | 0.20 | 35 | 5 | 10 | Yes | Sodium |
| 14 | acetate•Trihydrate | | acid | 1.0 | | | | | | pyrophosphate |
| 15 | | | | 1.2 | | | | | | |
| 16 | | | | 1.5 | | | | | | |
| 17 | | | | 2.0 | | | | | | |
| 18 | | | | 3.0 | | | | | | |
| 19 | Sodium | 0 | Sulfuric | 1.5 | 0.03 | 35 | 5 | 10 | Yes | Sodium |
| 20 | acetate•Trihydrate | 5 | acid | | 0.08 | | | | | pyrophosphate |
| 21 | | 20 | | | 0.16 | | | | | |
| 22 | | 50 | | | 0.48 | | | | | |
| 23 | Sodium | 30 | Sulfuric | 1.5 | 0.20 | 20 | 5 | 10 | Yes | Sodium |
| 24 | acetate•Trihydrate | | acid | | | 50 | | | | pyrophosphate |
| 25 | | | | | | 70 | | | | |
| 26 | Sodium | 30 | Sulfuric | 1.5 | 0.20 | 10 | 1 | 10 | Yes | Sodium |
| 27 | acetate•Trihydrate | | acid | | | | 5 | | | pyrophosphate |
| 28 | | | | | | | 10 | | | |
| 29 | | | | | | | 15 | | | |
| 30 | Sodium | 30 | Sulfuric | 1.5 | 0.20 | 10 | 5 | 10 | Yes | Sodium |
| 31 | acetate•Trihydrate | | acid | | | | | | | pyrophosphate |
| 32 | | | | | | | | | | |
| 33 | | | | | | | | | | |
| 34 | | | | | | | | | | |
| 35 | | | | | | | | | | |
| 36 | | | | | | | | | | |
| 37 | Sodium | 30 | Sulfuric | 1.5 | 0.20 | 10 | 5 | 10 | Yes | Sodium |
| 38 | acetate•Trihydrate | | acid | | | | | | | pyrophosphate |
| 39 | | | | | | | | | | |
| 40 | | | | | | | | | | |
| 41 | | | | | | | | | | |
| 42 | | | | | | | | | | |
| 43 | Sodium | 30 | Sulfuric | 1.5 | 0.20 | 10 | 5 | 10 | Yes | Sodium |
| 44 | acetate•Trihydrate | | acid | | | | | | | pyrophosphate |
| 45 | | | | | | | | | | |
| 46 | | | | | | | | | | |
| 47 | Sodium | 30 | Sulfuric | 1.5 | 0.20 | 10 | 5 | 10 | Yes | Sodium |
| 48 | acetate•Trihydrate | | acid | | | | | | | pyrophosphate |
| 49 | | | | | | | | | | |
| 50 | Sodium | 30 | Hydro- | 1.5 | 0.20 | 10 | 5 | 10 | Yes | Sodium |
| | acetate•Trihydrate | | chloric | | | | | | | pyrophosphate |
| | | | acid | | | | | | | |
| 51 | | | Nitric acid | | | | | | | |
| 52 | Potassium phthalate | 30 | Sulfuric | 1.5 | 0.42 | 10 | 5 | 10 | Yes | Sodium |
| 53 | Trisodium citrate | | acid | | 0.34 | | | | | pyrophosphate |
| | dihydrate | | | | | | | | | |
| 54 | Disodium succinate | | | | 0.62 | | | | | |
| | hexahydrate | | | | | | | | | |
| 55 | Sodium lactate | | | | 0.41 | | | | | |
| 56 | Sodium tartrate | | | | 0.48 | | | | | |
| | dihydrate | | | | | | | | | |
| 57 | Sodium borate | | | | 0.53 | | | | | |
| | decahydrate | | | | | | | | | |
| 58 | Trisodium | | | | 0.55 | | | | | |
| | phosphate•dodeca- | | | | | | | | | |
| | hydrate | | | | | | | | | |
| 59 | Sodium | 30 | Sulfuric | 1.5 | 0.20 | 10 | 5 | 10 | Yes | Sodium |
| | acetate•Trihydrate | | acid | | | | | | | triphosphate•Do- |
| | | | | | | | | | | decahydrate |
| 60 | | | | | | | | | | Sodium |
| | | | | | | | | | | triphosphate |
| 61 | Sodium | 30 | Sulfuric | 1.5 | 0.20 | 10 | 5 | 10 | Yes | Sodium |
| 62 | acetate•Trihydrate | | acid | | | | | | | pyrophosphate |
| 63 | | | | | | | | | | |
| 64 | | | | | | | | | | |
| 65 | Sodium | 30 | Sulfuric | 1.5 | 0.20 | 10 | 5 | 10 | Yes | Sodium |
| 66 | acetate•Trihydrate | | acid | | | | | | | pyrophosphate |
| 67 | | | | | | | | | | |
| 68 | Sodium | 30 | Sulfuric | 1.5 | 0.20 | 35 | 5 | 10 | No | Sodium |
| | acetate•Trihydrate | | acid | | | | | | | pyrophosphate |

TABLE 1-continued

| | Neutralization treatment | | | | | | | | |
|---|---|---|---|---|---|---|---|---|---|
| | Alkaline aqueous solution | | | | | | | | |
| | Phosphorus compound | Carbonate ions | | P | Carbonate ion | | | | Immer- |
| No. | Concent-ration (g/L) | Type of chemical | Concen-tration (g/L) | concen-tration (g/L) | concen-tration (g/L) | pH | Stir-ring (rpm) | Temp-erature (° C.) | sion time (sec) |
| 1 | — | — | — | — | | — | — | — | — |
| 2 | — | None | — | — | | 6.7 | 150 | 50 | 3 |
| 3 | 9.8 | None | — | 2.28 | — | 10.17 | 150 | 50 | 3 |
| 4 | | | | | | | | | |
| 5 | | | | | | | | | |
| 6 | | | | | | | | | |
| 7 | | | | | | | | | |
| 8 | 9.8 | Sodium | 2.86 | 2.28 | 0.60 | 10.54 | 150 | 50 | 3 |
| 9 | | carbonate•Decahydrate | | | | | | | |
| 10 | | | | | | | | | |
| 11 | | | | | | | | | |
| 12 | | | | | | | | | |
| 13 | 9.8 | Sodium | 2.86 | 2.28 | 0.60 | 10.54 | 150 | 50 | 3 |
| 14 | | carbonate•Decahydrate | | | | | | | |
| 15 | | | | | | | | | |
| 16 | | | | | | | | | |
| 17 | | | | | | | | | |
| 18 | | | | | | | | | |
| 19 | 9.8 | Sodium | 2.86 | 2.28 | 0.60 | 10.54 | 150 | 50 | 3 |
| 20 | | carbonate•Decahydrate | | | | | | | |
| 21 | | | | | | | | | |
| 22 | | | | | | | | | |
| 23 | 9.8 | Sodium | 2.86 | 2.28 | 0.60 | 10.54 | 150 | 50 | 3 |
| 24 | | carbonate•Decahydrate | | | | | | | |
| 25 | | | | | | | | | |
| 26 | 9.8 | Sodium | 2.86 | 2.28 | 0.60 | 10.54 | 150 | 50 | 3 |
| 27 | | carbonate•Decahydrate | | | | | | | |
| 28 | | | | | | | | | |
| 29 | | | | | | | | | |
| 30 | 0.01 | Sodium | 2.86 | 0.00 | 0.60 | 9.21 | 150 | 50 | 3 |
| 31 | 0.05 | carbonate•Decahydrate | | 0.01 | | 9.21 | | | |
| 32 | 0.5 | | | 0.12 | | 9.72 | | | |
| 33 | 1.0 | | | 0.23 | | 9.85 | | | |
| 34 | 20.0 | | | 4.66 | | 10.45 | | | |
| 35 | 40.0 | | | 9.32 | | 10.86 | | | |
| 36 | 100.0 | | | 23.31 | | 11.26 | | | |
| 37 | 9.8 | Sodium | 0.24 | 2.28 | 0.05 | 10.22 | 150 | 50 | 3 |
| 38 | | carbonate•Decahydrate | 0.48 | | 0.10 | 10.25 | | | |
| 39 | | | 2.86 | | 0.60 | 10.54 | | | |
| 40 | | | 5.72 | | 1.20 | 10.58 | | | |
| 41 | | | 28.60 | | 6.00 | 10.73 | | | |
| 42 | | | 57.20 | | 12.00 | 10.83 | | | |
| 43 | 9.8 | Sodium | 2.86 | 2.28 | 0.60 | 10.54 | 150 | 50 | 0.5 |
| 44 | | carbonate•Decahydrate | | | | | | | 1.5 |
| 45 | | | | | | | | | 5 |
| 46 | | | | | | | | | 10 |
| 47 | 9.8 | Sodium | 2.86 | 2.28 | 0.60 | 10.54 | 150 | 20 | 3 |
| 48 | | carbonate•Decahydrate | | | | | | 30 | |
| 49 | | | | | | | | 70 | |
| 50 | 9.8 | Sodium | 2.86 | 2.28 | 0.60 | 10.54 | 150 | 50 | 3 |
| 51 | | carbonate•Decahydrate | | | | | | | |
| 52 | 9.8 | Sodium | 2.86 | 2.28 | 0.60 | 10.54 | 150 | 50 | 3 |
| 53 | | carbonate•Decahydrate | | | | | | | |
| 54 | | | | | | | | | |
| 55 | | | | | | | | | |
| 56 | | | | | | | | | |
| 57 | | | | | | | | | |
| 58 | | | | | | | | | |
| 59 | 28 | Sodium | 2.86 | 2.28 | 0.60 | 10.54 | 150 | 50 | 3 |
| | | carbonate•Decahydrate | | | | | | | |
| 60 | 9.02 | | | 2.28 | | | | | |
| 61 | 9.8 | Carbon dioxide | 2.20 | 2.28 | 3.00 | 10.54 | 150 | 50 | 3 |
| 62 | | Manganese carbonate | 6.40 | | 3.00 | | | | |
| 63 | | Nickel carbonate | 12.43 | | 3.00 | | | | |
| 64 | | Potassium carbonate | 6.90 | | 3.00 | | | | |

TABLE 1-continued

| | | | | | | | | | |
|---|---|---|---|---|---|---|---|---|---|
| 65 | 0.5 | Sodium hydrogen carbonate | 0.42 | 0.12 | 0.30 | 8.35 | 150 | 50 | 3 |
| 66 | | | 4.20 | | 3.00 | 8.25 | | | |
| 67 | | | 8.40 | | 6.00 | 8.15 | | | |
| 68 | 0.5 | Sodium carbonate•Decahydrate | 2.86 | 0.12 | 0.60 | 10.54 | 150 | 50 | 3 |

TABLE 2

| | Oxide layer analytic results | | | | | | | | | |
|---|---|---|---|---|---|---|---|---|---|---|
| No. | Thickness (O) (nm) | Zn ($mg/m^2$) | S ($mg/m^2$) | P ($mg/m^2$) | C ($mg/m^2$) | Existence of zinc hydroxide | Existence of sulfate | Existence of carbonate | Existence of pyrophosphate | Incorporation of crystal structure |
| 1 | 8 | 21 | 0.0 | 0.0 | 0.0 | X | X | X | X | X |
| 2 | 31 | 82 | 10.1 | 0.0 | 0.0 | ○ | ○ | X | X | X |
| 3 | 11 | 29 | 3.6 | 0.7 | 0.0 | ○ | ○ | X | ○ | X |
| 4 | 13 | 34 | 4.2 | 0.8 | 0.0 | ○ | ○ | X | ○ | X |
| 5 | 16 | 42 | 5.2 | 1.0 | 0.0 | ○ | ○ | X | ○ | X |
| 6 | 17 | 45 | 5.5 | 1.1 | 0.0 | ○ | ○ | X | ○ | X |
| 7 | 19 | 50 | 6.2 | 1.2 | 0.0 | ○ | ○ | X | ○ | X |
| 8 | 21 | 55 | 5.5 | 1.3 | 0.5 | ○ | ○ | ○ | ○ | ○ |
| 9 | 25 | 66 | 6.5 | 1.6 | 0.6 | ○ | ○ | ○ | ○ | ○ |
| 10 | 31 | 82 | 8.1 | 2.0 | 0.8 | ○ | ○ | ○ | ○ | ○ |
| 11 | 46 | 121 | 12.0 | 2.9 | 1.1 | ○ | ○ | ○ | ○ | ○ |
| 12 | 63 | 166 | 16.4 | 4.0 | 1.5 | ○ | ○ | ○ | ○ | ○ |
| 13 | 45 | 119 | 11.7 | 2.8 | 1.1 | ○ | ○ | ○ | ○ | ○ |
| 14 | 42 | 111 | 10.9 | 2.6 | 1.0 | ○ | ○ | ○ | ○ | ○ |
| 15 | 38 | 100 | 9.9 | 2.4 | 0.9 | ○ | ○ | ○ | ○ | ○ |
| 16 | 31 | 82 | 8.1 | 2.0 | 0.8 | ○ | ○ | ○ | ○ | ○ |
| 17 | 28 | 74 | 7.3 | 1.8 | 0.7 | ○ | ○ | ○ | ○ | ○ |
| 18 | 27 | 71 | 7.0 | 1.7 | 0.7 | ○ | ○ | ○ | ○ | ○ |
| 19 | 23 | 61 | 6.0 | 1.4 | 0.6 | ○ | ○ | ○ | ○ | ○ |
| 20 | 25 | 66 | 6.5 | 1.6 | 0.6 | ○ | ○ | ○ | ○ | ○ |
| 21 | 33 | 87 | 8.6 | 2.1 | 0.8 | ○ | ○ | ○ | ○ | ○ |
| 22 | 28 | 74 | 7.3 | 1.8 | 0.7 | ○ | ○ | ○ | ○ | ○ |
| 23 | 25 | 66 | 6.5 | 1.6 | 0.6 | ○ | ○ | ○ | ○ | ○ |
| 24 | 31 | 82 | 8.1 | 2.0 | 0.8 | ○ | ○ | ○ | ○ | ○ |
| 25 | 23 | 61 | 6.0 | 1.4 | 0.6 | ○ | ○ | ○ | ○ | ○ |
| 26 | 28 | 74 | 7.3 | 1.8 | 0.7 | ○ | ○ | ○ | ○ | ○ |
| 27 | 31 | 82 | 8.1 | 2.0 | 0.8 | ○ | ○ | ○ | ○ | ○ |
| 28 | 33 | 87 | 8.6 | 2.1 | 0.8 | ○ | ○ | ○ | ○ | ○ |
| 29 | 31 | 82 | 8.1 | 2.0 | 0.8 | ○ | ○ | ○ | ○ | ○ |
| 30 | 31 | 82 | 8.1 | 0.1 | 0.8 | ○ | ○ | ○ | X | ○ |
| 31 | 31 | 82 | 8.1 | 0.2 | 0.8 | ○ | ○ | ○ | ○ | ○ |
| 32 | 30 | 79 | 7.8 | 0.7 | 0.7 | ○ | ○ | ○ | ○ | ○ |
| 33 | 32 | 84 | 8.3 | 1.5 | 0.8 | ○ | ○ | ○ | ○ | ○ |
| 34 | 31 | 82 | 8.1 | 4.9 | 0.8 | ○ | ○ | ○ | ○ | ○ |
| 35 | 30 | 79 | 7.8 | 9.4 | 0.7 | ○ | ○ | ○ | ○ | ○ |
| 36 | 30 | 79 | 7.8 | 18.9 | 0.7 | ○ | ○ | ○ | ○ | ○ |
| 37 | 19 | 50 | 6.0 | 1.2 | 0.1 | ○ | ○ | X | ○ | X |
| 38 | 25 | 66 | 7.3 | 1.6 | 0.2 | ○ | ○ | ○ | ○ | ○ |
| 39 | 31 | 82 | 8.1 | 2.0 | 0.8 | ○ | ○ | ○ | ○ | ○ |
| 40 | 32 | 84 | 7.8 | 2.0 | 1.0 | ○ | ○ | ○ | ○ | ○ |
| 41 | 30 | 79 | 6.8 | 1.9 | 1.1 | ○ | ○ | ○ | ○ | ○ |
| 42 | 30 | 79 | 5.8 | 1.9 | 1.5 | ○ | ○ | ○ | ○ | ○ |
| 43 | 33 | 87 | 8.6 | 2.1 | 0.8 | ○ | ○ | ○ | ○ | ○ |
| 44 | 33 | 87 | 8.6 | 2.1 | 0.8 | ○ | ○ | ○ | ○ | ○ |
| 45 | 32 | 84 | 8.3 | 2.0 | 0.8 | ○ | ○ | ○ | ○ | ○ |
| 46 | 30 | 79 | 7.8 | 1.9 | 0.7 | ○ | ○ | ○ | ○ | ○ |
| 47 | 30 | 79 | 7.8 | 1.9 | 0.7 | ○ | ○ | ○ | ○ | ○ |
| 48 | 32 | 84 | 8.3 | 2.0 | 0.8 | ○ | ○ | ○ | ○ | ○ |
| 49 | 31 | 82 | 8.1 | 2.0 | 0.8 | ○ | ○ | ○ | ○ | ○ |
| 50 | 33 | 84 | 0.0 | 2.0 | 0.0 | X | X | X | ○ | X |
| 51 | 30 | 82 | 0.0 | 2.0 | 0.0 | X | X | X | ○ | X |
| 52 | 33 | 87 | 8.6 | 2.1 | 0.8 | ○ | ○ | ○ | ○ | ○ |
| 53 | 32 | 84 | 8.3 | 2.0 | 0.8 | ○ | ○ | ○ | ○ | ○ |
| 54 | 31 | 82 | 8.1 | 2.0 | 0.8 | ○ | ○ | ○ | ○ | ○ |
| 55 | 30 | 79 | 7.8 | 1.9 | 0.7 | ○ | ○ | ○ | ○ | ○ |
| 56 | 32 | 84 | 8.3 | 2.0 | 0.8 | ○ | ○ | ○ | ○ | ○ |
| 57 | 34 | 90 | 8.8 | 2.1 | 0.8 | ○ | ○ | ○ | ○ | ○ |
| 58 | 33 | 87 | 8.6 | 2.1 | 0.8 | ○ | ○ | ○ | ○ | ○ |
| 59 | 31 | 82 | 8.1 | 2.0 | 0.8 | ○ | ○ | ○ | ○ | ○ |
| 60 | 32 | 84 | 8.3 | 2.0 | 0.8 | ○ | ○ | ○ | ○ | ○ |
| 61 | 31 | 82 | 8.1 | 2.0 | 0.8 | ○ | ○ | ○ | ○ | ○ |
| 62 | 35 | 92 | 9.1 | 2.2 | 0.9 | ○ | ○ | ○ | ○ | ○ |

TABLE 2-continued

| | | | | | | | | | | |
|---|---|---|---|---|---|---|---|---|---|---|
| 63 | 36 | 95 | 9.4 | 2.3 | 0.9 | ○ | ○ | ○ | ○ | ○ |
| 64 | 33 | 87 | 8.6 | 2.1 | 0.8 | ○ | ○ | ○ | ○ | ○ |
| 65 | 31 | 82 | 8.1 | 0.7 | 0.0 | ○ | ○ | X | X | X |
| 66 | 31 | 82 | 8.1 | 0.7 | 0.0 | ○ | ○ | X | X | X |
| 67 | 32 | 84 | 8.3 | 0.7 | 0.0 | ○ | ○ | X | X | X |
| 68 | 31 | 82 | 8.1 | 0.7 | 0.0 | ○ | ○ | X | X | X |

| | Press formability Friction coefficient | | | Alkali degreas-ability Wetting ratio after | Appearance unevenness | |
|---|---|---|---|---|---|---|
| No. | Condition 1 | Condition 2 | Condition 3 | degreasing (%) | Rating (grade) | Remark |
| 1 | 0.175 | 0.235 | 0.310 | 100 | 5 | Comparative Example |
| 2 | 0.129 | 0.165 | 0.250 | 30 | 5 | Comparative Example |
| 3 | 0.167 | 0.229 | 0.286 | 60 | 2 | Comparative Example |
| 4 | 0.159 | 0.223 | 0.295 | 60 | 2 | Comparative Example |
| 5 | 0.152 | 0.216 | 0.285 | 60 | 1 | Comparative Example |
| 6 | 0.149 | 0.210 | 0.301 | 60 | 1 | Comparative Example |
| 7 | 0.146 | 0.200 | 0.283 | 60 | 1 | Comparative Example |
| 8 | 0.139 | 0.192 | 0.189 | 100 | 5 | Invention Example |
| 9 | 0.139 | 0.169 | 0.175 | 100 | 5 | Invention Example |
| 10 | 0.128 | 0.163 | 0.163 | 100 | 5 | Invention Example |
| 11 | 0.116 | 0.154 | 0.159 | 100 | 5 | Invention Example |
| 12 | 0.119 | 0.147 | 0.154 | 100 | 5 | Invention Example |
| 13 | 0.115 | 0.154 | 0.163 | 100 | 5 | Invention Example |
| 14 | 0.115 | 0.152 | 0.162 | 100 | 5 | Invention Example |
| 15 | 0.120 | 0.164 | 0.167 | 100 | 5 | Invention Example |
| 16 | 0.120 | 0.163 | 0.170 | 100 | 5 | Invention Example |
| 17 | 0.132 | 0.174 | 0.172 | 100 | 5 | Invention Example |
| 18 | 0.134 | 0.176 | 0.173 | 100 | 5 | Invention Example |
| 19 | 0.142 | 0.185 | 0.175 | 100 | 5 | Invention Example |
| 20 | 0.134 | 0.180 | 0.172 | 100 | 5 | Invention Example |
| 21 | 0.120 | 0.165 | 0.169 | 100 | 5 | Invention Example |
| 22 | 0.129 | 0.170 | 0.170 | 100 | 5 | Invention Example |
| 23 | 0.132 | 0.182 | 0.173 | 100 | 5 | Invention Example |
| 24 | 0.120 | 0.165 | 0.170 | 100 | 5 | Invention Example |
| 25 | 0.133 | 0.177 | 0.170 | 100 | 5 | Invention Example |
| 26 | 0.130 | 0.168 | 0.173 | 100 | 5 | Invention Example |
| 27 | 0.125 | 0.168 | 0.168 | 100 | 5 | Invention Example |
| 28 | 0.127 | 0.167 | 0.165 | 100 | 5 | Invention Example |
| 29 | 0.126 | 0.167 | 0.169 | 100 | 5 | Invention Example |
| 30 | 0.128 | 0.168 | 0.170 | 60 | 5 | Comparative Example |
| 31 | 0.128 | 0.168 | 0.172 | 100 | 5 | Invention Example |
| 32 | 0.129 | 0.169 | 0.171 | 100 | 5 | Invention Example |
| 33 | 0.125 | 0.164 | 0.175 | 100 | 5 | Invention Example |
| 34 | 0.126 | 0.162 | 0.170 | 100 | 5 | Invention Example |
| 35 | 0.125 | 0.160 | 0.169 | 100 | 5 | Invention Example |
| 36 | 0.124 | 0.160 | 0.168 | 100 | 5 | Invention Example |
| 37 | 0.146 | 0.200 | 0.205 | 80 | 3 | Comparative Example |
| 38 | 0.124 | 0.162 | 0.180 | 100 | 4 | Invention Example |
| 39 | 0.122 | 0.168 | 0.159 | 100 | 5 | Invention Example |
| 40 | 0.125 | 0.165 | 0.155 | 100 | 5 | Invention Example |
| 41 | 0.128 | 0.163 | 0.153 | 100 | 5 | Invention Example |
| 42 | 0.128 | 0.163 | 0.149 | 100 | 5 | Invention Example |
| 43 | 0.126 | 0.159 | 0.159 | 100 | 5 | Invention Example |
| 44 | 0.126 | 0.159 | 0.160 | 100 | 5 | Invention Example |
| 45 | 0.117 | 0.166 | 0.160 | 100 | 5 | Invention Example |
| 46 | 0.128 | 0.164 | 0.163 | 100 | 5 | Invention Example |
| 47 | 0.128 | 0.164 | 0.165 | 100 | 5 | Invention Example |
| 48 | 0.123 | 0.167 | 0.168 | 100 | 5 | Invention Example |
| 49 | 0.122 | 0.167 | 0.173 | 100 | 5 | Invention Example |
| 50 | 0.121 | 0.165 | 0.251 | 100 | 5 | Comparative Example |
| 51 | 0.127 | 0.180 | 0.259 | 100 | 5 | Comparative Example |
| 52 | 0.122 | 0.164 | 0.168 | 100 | 5 | Invention Example |
| 53 | 0.122 | 0.160 | 0.168 | 100 | 5 | Invention Example |
| 54 | 0.123 | 0.178 | 0.169 | 100 | 5 | Invention Example |
| 55 | 0.129 | 0.171 | 0.165 | 100 | 5 | Invention Example |
| 56 | 0.131 | 0.173 | 0.164 | 100 | 5 | Invention Example |
| 57 | 0.138 | 0.182 | 0.163 | 100 | 5 | Invention Example |
| 58 | 0.136 | 0.189 | 0.165 | 100 | 5 | Invention Example |
| 59 | 0.135 | 0.185 | 0.170 | 100 | 5 | Invention Example |
| 60 | 0.137 | 0.181 | 0.160 | 100 | 5 | Invention Example |
| 61 | 0.132 | 0.186 | 0.166 | 100 | 5 | Invention Example |
| 62 | 0.139 | 0.187 | 0.165 | 100 | 5 | Invention Example |
| 63 | 0.136 | 0.184 | 0.169 | 100 | 5 | Invention Example |

TABLE 2-continued

| | | | | | | |
|---|---|---|---|---|---|---|
| 64 | 0.125 | 0.170 | 0.160 | 100 | 5 | Invention Example |
| 65 | 0.129 | 0.170 | 0.249 | 60 | 3 | Comparative Example |
| 66 | 0.131 | 0.172 | 0.234 | 60 | 3 | Comparative Example |
| 67 | 0.135 | 0.180 | 0.233 | 60 | 3 | Comparative Example |
| 68 | 0.130 | 0.175 | 0.251 | 60 | 3 | Comparative Example |

*○: Existence was confirmed, X: Existence was not confirmed, Crystal structure: $Zn_4(SO_4)_{1-x}(CO_3)_x(OH)_6 \cdot nH_2O$ Tables 1 and 2 show the followings:

No. 1 is a comparative example in which the oxide layer forming treatment and the neutralization treatment were not performed, and press formability was poor. No. 2 is a comparative example in which although the oxide layer forming treatment and the neutralization treatment were performed, the alkaline aqueous solution did not contain P ions and carbonate ions. Although some items related to press formability and appearance were satisfactory, the oxide layer did not contain sufficient P and C and some items related to press formability and degreasability were poor.

Nos. 3 to 7 are comparative examples in which the oxide layer forming treatment and the neutralization treatment were performed but the alkaline aqueous solution did not contain carbonate ions. The oxide layer did not contain a sufficient amount of C, the degreasability was insufficient, and appearance unevenness was observed. Due to dissolution of the oxide layer, press formability was low.

No. 30 is a comparative example in which the alkaline aqueous solution did not contain a sufficient amount of P ions. The oxide layer did not contain a sufficient amount of P, and degreasability was poor.

No. 37 is a comparative example in which the alkaline aqueous solution did not contain a sufficient amount of carbonate ions. The oxide layer did not contain a sufficient amount of C, press formability was insufficient due to dissolution of the oxide layer, and degreasability was poor. Appearance unevenness was also observed.

Nos. 50 and 51 are unsatisfactory examples (comparative examples) since the treatment solution for forming the oxide layer did not contain a sufficient amount of sulfate ions. Although some items related to press formability were satisfactory, the oxide layer did not contain S or C and some items related press formability, degreasability, and appearance unevenness were insufficient.

Nos. 65 to 67 are unsatisfactory examples (comparative examples) since the neutralization treatment solution had a pH outside the pH range of 9 to 12 although it contained sufficient amounts of P ions and carbonate ions. Some items related to press formability were satisfactory, but the oxide layer did not contain a sufficient amount of C. Some items related to press formability, degreasability, and appearance were insufficient.

No. 68 is a comparative example in which washing with water was not conducted between the oxide forming treatment and the neutralization treatment. Some items related to press formability were satisfactory, but the oxide layer did not contain sufficient amounts of P and C, and some items related to press formability, degreasability, and appearance were insufficient.

Nos. 8 to 29, 31 to 36, 38 to 49, and 52 to 64 are invention examples in which the oxide layer forming treatment and the neutralization treatment were performed in preferable condition ranges. The oxide layer contained sufficient amounts of Zn, S, P, and C, press formability and degreasability were excellent, and appearance was satisfactory.

No. 38 was subjected to detailed film analysis.

Results of gas chromatograph mass spectroscopy confirmed release of $CO_2$ in the range of 150° C. to 500° C., and found that C existed as a carbonate.

An X-ray photoelectron spectrometer was used to conduct analysis. The peak corresponding to Zn LMM was observed at around 987 eV, which showed that Zn existed as zinc hydroxide. Similarly, the peak corresponding to S 2p was observed at around 171 eV, which showed that S exited as a sulfate.

An X-ray absorption fine structure analyzer was used to conduct analysis. The peaks were observed at about 2153, 2158, and 2170 eV, which showed that P existed as a pyrophosphate.

Results of differential thermogravimetric analysis found a decrease of 11.2% in weight at 100° C. or lower, which showed that water of crystallization was contained.

Results of X-ray diffraction found that diffraction peaks were observed at 2θ of about 8.5°, 15.0°, 17.4°, 21.3°, 23.2°, 26.3°, 27.7°, 28.7°, 32.8°, 34.1°, 58.6°, and 59.4°.

The above-described results, compositional ratios, and charge balance showed that a crystal structure substance represented by $Zn_4(SO_4)_{0.95}(CO_3)_{0.05}(OH)_6.3.3H_2O$ was contained.

No. 39 was subjected to detailed film analysis.

Results of gas chromatograph mass spectroscopy confirmed release of $CO_2$ in the range of 150° C. to 500° C., and found that C existed as a carbonate.

An X-ray photoelectron spectrometer was used to conduct analysis. The peak corresponding to Zn LMM was observed at around 987 eV, which showed that Zn existed as zinc hydroxide. Similarly, the peak corresponding to S 2p was observed at around 171 eV, which showed that S exited as a sulfate.

An X-ray absorption fine structure analyzer was used to conduct analysis. The peaks were observed at about 2153, 2158, and 2170 eV, which showed that P existed as a pyrophosphate.

Results of differential thermogravimetric analysis found a decrease of 9.4% in weight at 100° C. or lower, which showed that water of crystallization was contained.

Results of X-ray diffraction found that diffraction peaks were observed at 2θ of about 8.8°, 15.0°, 17.9°, 21.3°, 23.2°, 27.0°, 29.2°, 32.9°, 34.7°, and 58.9°.

The above-described results, compositional ratios, and charge balance showed that a crystal structure substance represented by $Zn_4(SO_4)_{0.8}(CO_3)_{0.2}(OH)_6.2.7H_2O$ was contained.

No. 40 was subjected to detailed film analysis.

Results of gas chromatograph mass spectroscopy confirmed release of $CO_2$ in the range of 150° C. to 500° C., and found that C existed as a carbonate.

An X-ray photoelectron spectrometer was used to conduct analysis. The peak corresponding to Zn LMM was observed at around 987 eV, which showed that Zn existed as zinc hydroxide.

Similarly, the peak corresponding to S 2p was observed at around 171 eV, which showed that S exited as a sulfate.

An X-ray absorption fine structure analyzer was used to conduct analysis. The peaks were observed at about 2153, 2158, and 2170 eV, which showed that P existed as a pyrophosphate.

Results of differential thermogravimetric analysis found a decrease of 35.5% in weight at 100° C. or lower, which showed that water of crystallization was contained.

Results of X-ray diffraction found that diffraction peaks were observed at 2θ of about 8.9°, 15.0°, 18.3°, 21.3°, 23.2°, 27.4°, 29.5°, 32.9°, 34.7°, and 58.9°.

The above-described results, compositional ratios, and charge balance showed that a crystal structure substance represented by $Zn_4(SO_4)_{0.75}(CO_3)_{0.25}(OH)_6.10.0H_2O$ was contained.

No. 41 was subjected to detailed film analysis.

Results of gas chromatograph mass spectroscopy confirmed release of $CO_2$ in the range of 150° C. to 500° C., and found that C existed as a carbonate.

An X-ray photoelectron spectrometer was used to conduct analysis. The peak corresponding to Zn LMM was observed at around 987 eV, which showed that Zn existed as zinc hydroxide.

Similarly, the peak corresponding to S 2p was observed at around 171 eV, which showed that S exited as a sulfate.

An X-ray absorption fine structure analyzer was used to conduct analysis. The peaks were observed at about 2153, 2158, and 2170 eV, which showed that P existed as a pyrophosphate.

Results of differential thermogravimetric analysis found no significant decrease in weight at 100° C. or lower, which showed that water of crystallization was not contained.

Results of X-ray diffraction found that diffraction peaks were observed at 2θ of about 8.9°, 15.0°, 18.3°, 21.3°, 23.2°, 27.4°, 29.5°, 32.9°, 34.7°, and 58.9°.

The above-described results, compositional ratios, and charge balance showed that a crystal structure substance represented by $Zn_4(SO_4)_{0.7}(CO_3)_{0.3}(OH)_6$ was contained.

No. 42 was subjected to detailed film analysis.

Results of gas chromatograph mass spectroscopy confirmed release of $CO_2$ in the range of 150° C. to 500° C., and found that C existed as a carbonate.

An X-ray photoelectron spectrometer was used to conduct analysis. The peak corresponding to Zn LMM was observed at around 987 eV, which showed that Zn existed as zinc hydroxide.

Similarly, the peak corresponding to S 2p was observed at around 171 eV, which showed that S exited as a sulfate.

An X-ray absorption fine structure analyzer was used to conduct analysis. The peaks were observed at about 2153, 2158, and 2170 eV, which showed that P existed as a pyrophosphate.

Results of differential thermogravimetric analysis found a decrease of 18.6% in weight at 100° C. or lower, which showed that water of crystallization was contained.

Results of X-ray diffraction found that diffraction peaks were observed at 2θ of about 9.1°, 15.0°, 18.4°, 21.3°, 23.2°, 27.7°, 29.7°, 32.9°, 34.7°, and 58.9°.

The above-described results, compositional ratios, and charge balance showed that a crystal structure substance represented by $Zn_4(SO_4)_{0.6}(CO_3)_{0.4}(OH)_6.5.0H_2O$ was contained.

For other examples also, the same procedures were performed to confirm existence of zinc hydroxide, sulfate, carbonate, pyrophosphate, and water of crystallization and whether a crystal structure represented by $Zn_4(SO_4)_{1-X}(CO_3)_X(OH)_6.nH_2O$ was incorporated. Samples in which existence of those substances and incorporation of water of crystallization were confirmed are indicated by circles, and samples in which existence of those substances and incorporation of water of crystallization were not confirmed are indicated by Xs to show the results of the studies in Table 2 (presence or absence of water of crystallization is not indicated in the table). These results show that in invention examples, as with Nos. 38 to 40 and 42, zinc hydroxide, a sulfate, a carbonate, a pyrophosphate, and water of crystallization are present and a crystal structure substance represented by $Zn_4(SO_4)_{1-X}(CO_3)_X(OH)_6.nH_2O$ is contained.

Example 2

A cold-rolled steel sheet having a thickness of 0.7 mm was subjected to hot-dip galvanizing treatment and the resulting sheet was temper rolled. Subsequently, a surface activation treatment with an alkaline aqueous solution was conducted on some samples by using an alkaline aqueous solution adjusted to the conditions shown in Table 3. Then an oxide layer forming treatment was conducted in which the steel sheet was immersed in a sulfuric acid acidic solution controlled to the conditions shown in Table 3, roll-squeezed, and then held for a particular time shown in Table 3. After washing with water, the steel sheet was dried. Then a neutralization treatment was conducted under the conditions shown in Table 3. The sulfate ion concentration in the sulfuric acid acidic solution was 15 g/L.

The hot-dip galvanized steel sheet obtained as above was analyzed to determine the thickness of the oxide layer on the surface and evaluate press formability (sliding properties), degreasability, and appearance unevenness by the same procedures as in Example 1.

Table 4 shows the results.

TABLE 3

| | Activation treatment Alkaline aqueous solution | | | | | Oxide layer forming treatment | | | | | | |
|---|---|---|---|---|---|---|---|---|---|---|---|---|
| | | | | | | Acidic solution | | | | pH-increasing property | Temperature (° C.) | Coating weight of acidic solution film (g/m²) |
| | | | | | | pH buffer | | pH adjustor | | | | |
| No. | Type of chemical | Concentration (g/L) | Temperature (° C.) | pH | Immersion time (sec) | Type of chemical | Concentration (g/L) | Type of chemical | pH | | | |
| 69 | — | — | — | — | — | No treatment | — | — | — | — | — | — |
| 70 | — | — | — | — | — | Sodium acetate•Trihydrate | 30 | Sulfuric acid | 1.5 | 0.20 | 35 | 5 |
| 71 | | | | | | | | | | | | |
| 72 | | | | | | | | | | | | |
| 73 | | | | | | | | | | | | |

TABLE 3-continued

| | | | | | | | | | | | | |
|---|---|---|---|---|---|---|---|---|---|---|---|---|
| 74 | | | | | | | | | | | | |
| 75 | | | | | | | | | | | | |
| 76 | — | — | — | — | — | Sodium acetate•Tri-hydrate | 30 | Sulfuric acid | 1.5 | 0.20 | 35 | 5 |
| 77 | | | | | | | | | | | | |
| 78 | | | | | | | | | | | | |
| 79 | | | | | | | | | | | | |
| 80 | | | | | | | | | | | | |
| 81 | NaOH | 0.1 | 50 | 10.0 | 5 | Sodium acetate•Tri-hydrate | 30 | Sulfuric acid | 1.5 | 0.20 | 35 | 5 |
| 82 | | 1 | | 12.0 | | | | | | | | |
| 83 | | 5 | | 12.5 | | | | | | | | |
| 84 | | 10 | | 13.0 | | | | | | | | |
| 85 | | 100 | | 14.0 | | | | | | | | |
| 86 | NaOH | 5 | 20 | 12.5 | 5 | Sodium acetate•Tri-hydrate | 30 | Sulfuric acid | 1.5 | 0.20 | 35 | 5 |
| 87 | | | 30 | | | | | | | | | |
| 88 | | | 40 | | | | | | | | | |
| 89 | | | 60 | | | | | | | | | |
| 90 | | | 70 | | | | | | | | | |

| | Oxide layer forming treatment | | Neutralization treatment | | | | | | | | | |
|---|---|---|---|---|---|---|---|---|---|---|---|---|
| | | | Alkaline aqueous solution | | | | | | | | | |
| | | | Phosphorus compound | | Carbonate ions | | P | Carbonate ion | | | | |
| No. | Holding time (sec) | Washing with water | Type of chemical | Concentration (g/L) | Type of chemical | Concentration (g/L) | concentration (g/L) | concentration (g/L) | pH | Stirring (rpm) | Temperature (° C.) | Immersion time (sec) |
| 69 | — | — | No treatment | — | — | — | — | — | — | — | — | — |
| 70 | 10 | Yes | None | — | None | — | — | — | 6.7 | 150 | 50 | 3 |
| 71 | 3 | | Sodium pyrophosphate | 9.8 | None | — | 2.28 | — | 10.17 | 150 | 50 | 3 |
| 72 | 5 | | | | | | | | | | | |
| 73 | 10 | | | | | | | | | | | |
| 74 | 30 | | | | | | | | | | | |
| 75 | 60 | | | | | | | | | | | |
| 76 | 3 | Yes | Sodium pyrophosphate | 9.8 | Sodium carbonate•Decahydrate | 2.86 | 2.28 | 0.60 | 10.54 | 150 | 50 | 3 |
| 77 | 5 | | | | | | | | | | | |
| 78 | 10 | | | | | | | | | | | |
| 79 | 30 | | | | | | | | | | | |
| 80 | 60 | | | | | | | | | | | |
| 81 | 10 | Yes | Sodium pyrophosphate | 9.8 | Sodium carbonate•Decahydrate | 2.86 | 2.28 | 0.60 | 10.54 | 150 | 50 | 3 |
| 82 | 10 | | | | | | | | | | | |
| 83 | 10 | | | | | | | | | | | |
| 84 | 10 | | | | | | | | | | | |
| 85 | 10 | | | | | | | | | | | |
| 86 | 10 | Yes | Sodium pyrophosphate | 9.8 | Sodium carbonate•Decahydrate | 2.86 | 2.28 | 0.60 | 10.54 | 150 | 50 | 3 |
| 87 | 10 | | | | | | | | | | | |
| 88 | 10 | | | | | | | | | | | |
| 89 | 10 | | | | | | | | | | | |
| 90 | 10 | | | | | | | | | | | |

TABLE 4

| | Oxide layer analytic results | | | | | | | | | |
|---|---|---|---|---|---|---|---|---|---|---|
| No. | Thickness (O) (nm) | Zn ($mg/m^2$) | S ($mg/m^2$) | P ($mg/m^2$) | C ($mg/m^2$) | Existence of zinc hydroxide | Existence of sulfate | Existence of carbonate | Existence of pyrophosphate | Incorporation of crystal structure |
| 69 | 8 | 21 | 0.0 | 0.0 | 0.0 | X | X | X | X | X |
| 70 | 28 | 74 | 9.1 | 0.0 | 0.0 | ○ | ○ | X | X | X |
| 71 | 12 | 32 | 3.9 | 0.8 | 0.0 | ○ | ○ | X | ○ | X |
| 72 | 18 | 48 | 5.8 | 1.1 | 0.0 | ○ | ○ | X | ○ | X |
| 73 | 20 | 53 | 6.5 | 1.3 | 0.0 | ○ | ○ | X | ○ | X |
| 74 | 25 | 66 | 8.1 | 1.6 | 0.0 | ○ | ○ | X | ○ | X |
| 75 | 29 | 77 | 9.4 | 1.8 | 0.0 | ○ | ○ | X | ○ | X |
| 76 | 20 | 53 | 6.5 | 1.0 | 0.4 | ○ | ○ | ○ | ○ | ○ |
| 77 | 23 | 61 | 7.5 | 1.2 | 0.5 | ○ | ○ | ○ | ○ | ○ |
| 78 | 28 | 74 | 9.1 | 1.8 | 0.7 | ○ | ○ | ○ | ○ | ○ |
| 79 | 42 | 111 | 10.9 | 2.6 | 1.0 | ○ | ○ | ○ | ○ | ○ |
| 80 | 51 | 135 | 13.3 | 3.2 | 1.2 | ○ | ○ | ○ | ○ | ○ |
| 81 | 32 | 84 | 8.3 | 2.0 | 0.8 | ○ | ○ | ○ | ○ | ○ |
| 82 | 45 | 119 | 11.7 | 2.8 | 1.1 | ○ | ○ | ○ | ○ | ○ |
| 83 | 63 | 166 | 16.4 | 4.0 | 1.5 | ○ | ○ | ○ | ○ | ○ |

TABLE 4-continued

| | | | | | | | | | | |
|---|---|---|---|---|---|---|---|---|---|---|
| 84 | 62 | 164 | 16.1 | 3.9 | 1.5 | ○ | ○ | ○ | ○ | ○ |
| 85 | 65 | 172 | 16.9 | 4.1 | 1.6 | ○ | ○ | ○ | ○ | ○ |
| 86 | 45 | 119 | 11.7 | 2.8 | 1.1 | ○ | ○ | ○ | ○ | ○ |
| 87 | 59 | 156 | 15.3 | 3.7 | 1.4 | ○ | ○ | ○ | ○ | ○ |
| 88 | 61 | 161 | 15.9 | 3.8 | 1.5 | ○ | ○ | ○ | ○ | ○ |
| 89 | 62 | 164 | 16.1 | 3.9 | 1.5 | ○ | ○ | ○ | ○ | ○ |
| 90 | 64 | 169 | 16.6 | 4.0 | 1.6 | ○ | ○ | ○ | ○ | ○ |

| | Press formability Friction coefficient | | | Alkali degreasability Wetting ratio after degreasing | Appearance unevenness Rating | |
|---|---|---|---|---|---|---|
| No. | Condition 1 | Condition 2 | Condition 3 | (%) | (grade) | Remark |
| 69 | 0.146 | 0.296 | 0.352 | 100 | 5 | Comparative Example |
| 70 | 0.099 | 0.189 | 0.250 | 30 | 5 | Comparative Example |
| 71 | 0.132 | 0.253 | 0.280 | 60 | 2 | Comparative Example |
| 72 | 0.128 | 0.242 | 0.293 | 60 | 2 | Comparative Example |
| 73 | 0.120 | 0.225 | 0.291 | 60 | 1 | Comparative Example |
| 74 | 0.108 | 0.203 | 0.263 | 60 | 1 | Comparative Example |
| 75 | 0.099 | 0.195 | 0.255 | 60 | 1 | Comparative Example |
| 76 | 0.111 | 0.199 | 0.179 | 100 | 5 | Invention Example |
| 77 | 0.108 | 0.196 | 0.175 | 100 | 5 | Invention Example |
| 78 | 0.096 | 0.183 | 0.173 | 100 | 5 | Invention Example |
| 79 | 0.094 | 0.176 | 0.170 | 100 | 5 | Invention Example |
| 80 | 0.090 | 0.163 | 0.160 | 100 | 5 | Invention Example |
| 81 | 0.086 | 0.193 | 0.163 | 100 | 5 | Invention Example |
| 82 | 0.080 | 0.190 | 0.162 | 100 | 5 | Invention Example |
| 83 | 0.075 | 0.156 | 0.160 | 100 | 5 | Invention Example |
| 84 | 0.073 | 0.153 | 0.158 | 100 | 5 | Invention Example |
| 85 | 0.076 | 0.158 | 0.153 | 100 | 5 | Invention Example |
| 86 | 0.086 | 0.175 | 0.162 | 100 | 5 | Invention Example |
| 87 | 0.079 | 0.155 | 0.159 | 100 | 5 | Invention Example |
| 88 | 0.077 | 0.154 | 0.155 | 100 | 5 | Invention Example |
| 89 | 0.078 | 0.159 | 0.152 | 100 | 5 | Invention Example |
| 90 | 0.073 | 0.152 | 0.151 | 100 | 5 | Invention Example |

*○: Existence was confirmed, X: Existence was not confirmed, Crystal structure: $Zn_4(SO_4)_{1-X}(CO_3)_X(OH)_6 \cdot nH_2O$ Tables 3 and 4 show the followings.

No. 69 is a comparative example in which the oxide layer forming treatment and the neutralization treatment were not conducted. The press formability was poor.

No. 70 is a comparative example in which the oxide layer forming treatment and the neutralization treatment were performed but the alkaline aqueous solution did not contain carbonate ions and P ions. The oxide layer did not contain sufficient amounts of P and C and degreasability was poor although press formability and appearance were satisfactory.

Nos. 71 to 75 are comparative examples in which the oxide layer forming treatment and the neutralization treatment were performed but the alkaline aqueous solution did not contain carbonate ions. The oxide layer did not contain a sufficient amount of C, degreasability was insufficient, and appearance was poor. Due to dissolution of the oxide layer, press formability was low.

Nos. 76 to 80 are invention examples in which the oxide layer forming treatment and the neutralization treatment were performed in preferable condition ranges. The oxide layer contained sufficient amounts of Zn, S, P, and C, press formability and degreasability were excellent, and appearance was satisfactory.

Nos. 81 to 90 are invention examples in which the activation treatment, the oxide layer forming treatment, and the neutralization treatment were conducted in preferable condition ranges. The oxide layer contained sufficient amounts of Zn, S, P, and C, press formability and degreasability were excellent, and appearance was satisfactory. In particular, compared to Nos. 76 to 79, press formability was superior.

For all examples of Example 2, the existence of zinc hydroxide, a sulfate, a carbonate, a pyrophosphate, and water of crystallization and whether a crystal structure substance represented by $Zn_4(SO_4)_{1-X}(CO_3)_X(OH)_6.nH_2O$ is incorporated were studied by the same procedures as in Example 1. Samples in which existence of those substances and incorporation of water of crystallization were confirmed are indicated by circles, and samples in which existence of those substances and incorporation of water of crystallization were not confirmed are indicated by Xs to show the results of the studies in Table 4 (presence or absence of water of crystallization is not indicated in the table). These results show that in invention examples, as with Nos. 38 to 40 and 42, zinc hydroxide, a sulfate, a carbonate, a pyrophosphate, and water of crystallization are present and a crystal structure substance represented by $Zn_4(SO_4)_{1-X}(CO_3)_X(OH)_6.nH_2O$ is contained.

Example 3

A cold-rolled steel sheet having a thickness of 0.7 mm was subjected to electrogalvanizing treatment. A surface activation treatment with an alkaline aqueous solution was conducted with an alkaline aqueous solution adjusted to conditions shown in Table 5. Then an oxide layer forming treatment was conducted in which the steel sheet was immersed in a sulfuric acid acidic solution controlled to the conditions shown in Table 5, roll-squeezed, and then held for a particular time shown in Table 5. After washing with water, the steel sheet was dried. Then a neutralization treatment was conducted under the conditions shown in Table 5. The sulfate ion concentration in the sulfuric acid acidic solution was 15 g/L.

The electrogalvanized steel sheet obtained as above was analyzed to determine the thickness of the oxide layer on the surface and evaluate press formability (sliding properties) and degreasability by the same procedures as in Example 1. The results are shown in Table 6.

TABLE 5

| | Activation treatment | | | | | Oxide layer forming treatment | | | | | | | |
|---|---|---|---|---|---|---|---|---|---|---|---|---|---|
| | Alkaline aqueous solution | | | | | Acidic solution | | | | | | Coating | |
| | | | | | | pH buffer | | | | | | weight | |
| No. | Type of chemical | Concentration (g/L) | Temperature (° C.) | pH | Immersion time (sec) | Type of chemical | Concentration (g/L) | pH adjustor Type of chemical | pH adjustor pH | pH-increasing property | Temperature (° C.) | of acidic solution film (g/m$^2$) | Holding time (sec) |
| 91 | — | — | — | — | — | No treatment | — | — | — | — | — | — | — |
| 92 | — | — | — | — | — | Sodium acetate•Trihydrate | 30 | Sulfuric acid | 1.5 | 0.20 | 35 | 5 | 10 |
| 93 | | | | | | | | | | | | | 3 |
| 94 | | | | | | | | | | | | | 5 |
| 95 | | | | | | | | | | | | | 10 |
| 96 | | | | | | | | | | | | | 30 |
| 97 | | | | | | | | | | | | | 60 |
| 98 | — | — | — | — | — | Sodium acetate•Trihydrate | 30 | Sulfuric acid | 1.5 | 0.20 | 35 | 5 | 3 |
| 99 | | | | | | | | | | | | | 5 |
| 100 | | | | | | | | | | | | | 10 |
| 101 | | | | | | | | | | | | | 30 |
| 102 | | | | | | | | | | | | | 60 |
| 103 | NaOH | 0.1 | 50 | 10.0 | 5 | Sodium acetate•Trihydrate | 30 | Sulfuric acid | 1.5 | 0.20 | 35 | 5 | 10 |
| 104 | | 1 | | 12.0 | | | | | | | | | 10 |
| 105 | | 5 | | 12.5 | | | | | | | | | 10 |
| 106 | | 10 | | 13.0 | | | | | | | | | 10 |
| 107 | | 100 | | 14.0 | | | | | | | | | 10 |
| 108 | NaOH | 5 | 20 | 12.5 | 5 | Sodium acetate•Trihydrate | 30 | Sulfuric acid | 1.5 | 0.20 | 35 | 5 | 10 |
| 109 | | | 30 | | | | | | | | | | 10 |
| 110 | | | 40 | | | | | | | | | | 10 |
| 111 | | | 60 | | | | | | | | | | 10 |
| 112 | | | 70 | | | | | | | | | | 10 |

| | Oxide layer forming treatment | Neutralization treatment | | | | | | | | | |
|---|---|---|---|---|---|---|---|---|---|---|---|
| | | Alkaline aqueous solution | | | | | | | | | |
| | | Phosphorus compound | | Carbonate ions | | P | Carbonate ion | | | | |
| No. | Washing with water | Type of chemical | Concentration (g/L) | Type of chemical | Concentration (g/L) | concentration (g/L) | concentration (g/L) | pH | Stirring (rpm) | Temperature (° C.) | Immersion time (sec) |
| 91 | — | No treatment | — | — | — | — | — | — | — | — | — |
| 92 | Yes | None | — | None | — | — | — | 6.7 | 150 | 50 | 3 |
| 93 | | Sodium pyrophosphate | 9.8 | None | — | 2.28 | — | 10.17 | 150 | 50 | 3 |
| 94 | | | | | | | | | | | |
| 95 | | | | | | | | | | | |
| 96 | | | | | | | | | | | |
| 97 | | | | | | | | | | | |
| 98 | Yes | Sodium pyrophosphate | 9.8 | Sodium carbonate•Decahydrate | 2.86 | 2.28 | 0.60 | 10.54 | 150 | 50 | 3 |
| 99 | | | | | | | | | | | |
| 100 | | | | | | | | | | | |
| 101 | | | | | | | | | | | |
| 102 | | | | | | | | | | | |
| 103 | Yes | Sodium pyrophosphate | 9.8 | Sodium carbonate•Decahydrate | 2.86 | 2.28 | 0.60 | 10.54 | 150 | 50 | 3 |
| 104 | | | | | | | | | | | |
| 105 | | | | | | | | | | | |
| 106 | | | | | | | | | | | |
| 107 | | | | | | | | | | | |
| 108 | Yes | Sodium pyrophosphate | 9.8 | Sodium carbonate•Decahydrate | 2.86 | 2.28 | 0.60 | 10.54 | 150 | 50 | 3 |
| 109 | | | | | | | | | | | |
| 110 | | | | | | | | | | | |
| 111 | | | | | | | | | | | |
| 112 | | | | | | | | | | | |

TABLE 6

| No. | Oxide layer analytic results: Thickness (O) (nm) | Zn ($mg/m^2$) | S ($mg/m^2$) | P ($mg/m^2$) | C ($mg/m^2$) | Existence of zinc hydroxide | Existence of sulfate | Existence of carbonate | Existence of pyrophosphate | Incorporation of crystal structure |
|---|---|---|---|---|---|---|---|---|---|---|
| 91 | 5 | 13 | 0.0 | 0.0 | 0.0 | X | X | X | X | X |
| 92 | 26 | 69 | 8.4 | 0.0 | 0.0 | ○ | ○ | X | X | X |
| 93 | 12 | 32 | 3.9 | 0.8 | 0.0 | ○ | ○ | X | ○ | X |
| 94 | 18 | 48 | 5.8 | 1.1 | 0.0 | ○ | ○ | X | ○ | X |
| 95 | 20 | 53 | 6.5 | 1.3 | 0.0 | ○ | ○ | X | ○ | X |
| 96 | 25 | 66 | 8.1 | 1.6 | 0.0 | ○ | ○ | X | ○ | X |
| 97 | 29 | 77 | 9.4 | 1.8 | 0.0 | ○ | ○ | X | ○ | X |
| 98 | 20 | 53 | 6.5 | 0.8 | 0.3 | ○ | ○ | ○ | ○ | ○ |
| 99 | 25 | 66 | 8.1 | 1.1 | 0.4 | ○ | ○ | ○ | ○ | ○ |
| 100 | 32 | 84 | 10.4 | 1.4 | 0.5 | ○ | ○ | ○ | ○ | ○ |
| 101 | 40 | 106 | 10.4 | 2.5 | 1.0 | ○ | ○ | ○ | ○ | ○ |
| 102 | 50 | 132 | 13.0 | 3.1 | 1.2 | ○ | ○ | ○ | ○ | ○ |
| 103 | 26 | 69 | 6.8 | 1.6 | 0.6 | ○ | ○ | ○ | ○ | ○ |
| 104 | 46 | 121 | 12.0 | 2.9 | 1.1 | ○ | ○ | ○ | ○ | ○ |
| 105 | 62 | 164 | 16.1 | 3.9 | 1.5 | ○ | ○ | ○ | ○ | ○ |
| 106 | 64 | 169 | 16.6 | 4.0 | 1.6 | ○ | ○ | ○ | ○ | ○ |
| 107 | 63 | 166 | 16.4 | 4.0 | 1.5 | ○ | ○ | ○ | ○ | ○ |
| 108 | 40 | 106 | 10.4 | 2.5 | 1.0 | ○ | ○ | ○ | ○ | ○ |
| 109 | 58 | 153 | 15.1 | 3.7 | 1.4 | ○ | ○ | ○ | ○ | ○ |
| 110 | 62 | 164 | 16.1 | 3.9 | 1.5 | ○ | ○ | ○ | ○ | ○ |
| 111 | 61 | 161 | 15.9 | 3.8 | 1.5 | ○ | ○ | ○ | ○ | ○ |
| 112 | 64 | 169 | 16.6 | 4.0 | 1.6 | ○ | ○ | ○ | ○ | ○ |

| No. | Press formability Friction coefficient: Condition 1 | Condition 2 | Condition 3 | Alkali degreasability Wetting ratio after degreasing (%) | Appearance unevenness Rating (grade) | Remark |
|---|---|---|---|---|---|---|
| 91 | 0.172 | 0.305 | 0.326 | 100 | 5 | Comparative Example |
| 92 | 0.099 | 0.189 | 0.263 | 30 | 5 | Comparative Example |
| 93 | 0.132 | 0.253 | 0.313 | 60 | 2 | Comparative Example |
| 94 | 0.128 | 0.242 | 0.302 | 60 | 2 | Comparative Example |
| 95 | 0.120 | 0.225 | 0.286 | 60 | 1 | Comparative Example |
| 96 | 0.108 | 0.203 | 0.276 | 60 | 1 | Comparative Example |
| 97 | 0.099 | 0.195 | 0.260 | 60 | 1 | Comparative Example |
| 98 | 0.113 | 0.210 | 0.179 | 100 | 5 | Invention Example |
| 99 | 0.105 | 0.205 | 0.178 | 100 | 5 | Invention Example |
| 100 | 0.098 | 0.199 | 0.170 | 100 | 5 | Invention Example |
| 101 | 0.096 | 0.185 | 0.163 | 100 | 5 | Invention Example |
| 102 | 0.080 | 0.176 | 0.162 | 100 | 5 | Invention Example |
| 103 | 0.096 | 0.190 | 0.173 | 100 | 5 | Invention Example |
| 104 | 0.086 | 0.186 | 0.160 | 100 | 5 | Invention Example |
| 105 | 0.075 | 0.156 | 0.159 | 100 | 5 | Invention Example |
| 106 | 0.074 | 0.157 | 0.153 | 100 | 5 | Invention Example |
| 107 | 0.073 | 0.160 | 0.152 | 100 | 5 | Invention Example |
| 108 | 0.076 | 0.169 | 0.162 | 100 | 5 | Invention Example |
| 109 | 0.070 | 0.160 | 0.159 | 100 | 5 | Invention Example |
| 110 | 0.075 | 0.150 | 0.155 | 100 | 5 | Invention Example |
| 111 | 0.076 | 0.153 | 0.154 | 100 | 5 | Invention Example |
| 112 | 0.073 | 0.156 | 0.153 | 100 | 5 | Invention Example |

*○: Existence was confirmed, X: Existence was not confirmed, Crystal structure: $Zn_4(SO_4)_{1-x}(CO_3)_x(OH)_6 \cdot nH_2O$ Tables 5 and 6 show the followings.

No. 91 is a comparative example in which the oxide layer forming treatment and the neutralization treatment were not conducted. The press formability was poor.

No. 92 is a comparative example in which the oxide layer forming treatment and the neutralization treatment were conducted but the alkaline aqueous solution did not contain carbonate ions and P ions. The oxide layer did not contain sufficient amounts of P and C, and degreasability was poor although press formability and appearance were satisfactory.

Nos. 93 to 97 are comparative examples in which the oxide layer forming treatment and the neutralization treatment were performed but the alkaline aqueous solution did not contain carbonate ions. The oxide layer did not contain a sufficient amount of C, degreasability was insufficient, and appearance unevenness was observed. Due to dissolution of the oxide layer, press formability was degraded.

Nos. 98 to 102 are invention examples in which the oxide layer forming treatment and the neutralization treatment were performed in preferable condition ranges. The oxide layer contained sufficient amounts of Zn, S, P, and C, press formability and degreasability were excellent, and appearance was satisfactory.

Nos. 103 to 112 are invention examples in which the activation treatment, the oxide layer forming treatment, and the neutralization treatment were conducted in preferable condition ranges. The oxide layer contained sufficient amounts of Zn, S, P, and C, press formability and degreasability were excellent, and appearance was satisfactory. In particular, compared to Nos. 98 to 102, press formability was superior.

For all examples of Example 3, the existence of zinc hydroxide, a sulfate, a carbonate, a pyrophosphate, and water of crystallization and whether a crystal structure represented by $Zn_4(SO_4)_{1-X}(CO_3)_X(OH)_6.nH_2O$ is incorporated were studied by the same procedures as in Example 1. Samples in which existence of those substances and incorporation of water of crystallization were confirmed are indicated by circles, and samples in which existence of those substances and incorporation of water of crystallization were not confirmed are indicated by Xs to show the results of the studies in Table 6 (presence or absence of water of crystallization is not indicated in the table). These results show that in invention examples, as with Nos. 38 to 40 and 42, zinc hydroxide, a sulfate, a carbonate, a pyrophosphate, and water of crystallization are present and a crystal structure substance represented by $Zn_4(SO_4)_{1-Z}(CO_3)_X(OH)_6.nH_2O$ is contained.

REFERENCE SIGNS LIST

1 friction coefficient measurement sample
2 sample table
3 slide table
4 roller
5 slide table supporting stage
6 bead
7 first load cell
8 second load cell
9 rail
N pressing load
F sliding resistance force
10 static friction coefficient measurement instrument
11 die
12 die
100 friction coefficient measurement sample
P pressing load
F' pull-out load

The invention claimed is:

1. A galvanized steel sheet comprising a steel sheet and a galvanized coating layer formed on the steel sheet, wherein the coating layer includes an oxide layer in a surface layer, the oxide layer having an average thickness of 20 nm or more, and the oxide layer comprises Zn, O, H, S, C, P, and unavoidable impurities, and contains 50 mg/m$^2$ or more of Zn, 5 mg/m$^2$ or more of S, 0.2 mg/m$^2$ or more of C, and 0.2 mg/m$^2$ or more of P.

2. The galvanized steel sheet according to claim 1, wherein a sulfate group, a carbonate group, a hydroxyl group, and a phosphate group exist in the oxide layer.

3. The galvanized steel sheet according to claim 1, wherein the oxide layer contains a crystal structure represented by $Zn_4(SO_4)_{1-X}(CO_3)_X(OH)_6.nH_2O$, where X is a real number in the range of $0<X<1$ and n is a real number in the range of $0\leq n\leq 10$.

4. The galvanized steel sheet according to claim 2, wherein the oxide layer contains a crystal structure represented by $Zn_4(SO_4)_{1-X}(CO_3)_X(OH)_6.nH_2O$, where X is a real number in the range of $0<X<1$ and n is a real number in the range of $0\leq n\leq 10$.

5. The galvanized steel sheet according to claim 1, wherein the oxide layer contains at least one selected from $PO_4^{3-}$, $P_2O_7^{4-}$, $P_3O_{10}^{5-}$, and an inorganic acid or a metal compound of any of the foregoing, and the metal compound contains at least one selected from sodium and zinc.

6. The galvanized steel sheet according to claim 2, wherein the oxide layer contains at least one selected from $PO_4^{3-}$, $P_2O_7^{4-}$, $P_3O_{10}^{5-}$, and an inorganic acid or a metal compound of any of the foregoing, and the metal compound contains at least one selected from sodium and zinc.

7. The galvanized steel sheet according to claim 3, wherein the oxide layer contains at least one selected from $PO_4^{3-}$, $P_2O_7^{4-}$, $P_3O_{10}^{5-}$, and an inorganic acid or a metal compound of any of the foregoing, and the metal compound contains at least one selected from sodium and zinc.

8. The galvanized steel sheet according to claim 4, wherein the oxide layer contains at least one selected from $PO_4^{3-}$, $P_2O_7^{4-}$, $P_3O_{10}^{5-}$, and an inorganic acid or a metal compound of any of the foregoing, and the metal compound contains at least one selected from sodium and zinc.

9. The galvanized steel sheet according to claim 1, wherein the galvanized steel sheet is a hot-dip galvannealed steel sheet, a hot-dip galvanized steel sheet, or an electrogalvanized steel sheet.

10. A method for producing the galvanized steel sheet according to claim 1, the method comprising:

an oxide layer forming step of bringing a galvanized steel sheet into contact with an acidic solution containing sulfate ions, then holding the galvanized steel sheet in contact for 1 to 60 seconds, and then washing the galvanized steel sheet with water; and a neutralization treatment step of holding a surface of an oxide layer, which has been formed in the oxide layer forming step, in contact with an alkaline aqueous solution for 0.5 seconds or longer, and then performing washing with water and drying, wherein the alkaline aqueous solution contains P ions at a P concentration of 0.01 g/L or more and carbonate ions at a carbonate ion concentration of 0.1 g/L or more, and has a pH of 9 to 12.

11. The method for producing a galvanized steel sheet according to claim 10, wherein the alkaline aqueous solution contains a carbonate and at least one phosphorus compound selected from a phosphate, a pyrophosphate, and a triphosphate.

12. The method for producing a galvanized steel sheet according to claim 10, wherein the carbonate ions are contained at a carbonate ion concentration of 0.6 g/L or more.

13. The method for producing a galvanized steel sheet according to claim 10, wherein the carbonate ions are contained at a carbonate ion concentration of 1.2 g/L or more.

14. The method for producing a galvanized steel sheet according to claim 10, wherein the alkaline aqueous solution has a pH of 9 to 12 and a temperature of 20° C. to 70° C.

15. The method for producing a galvanized steel sheet according to claim 10, wherein the acidic solution has a pH buffering action and has a pH-increasing property in the range of 0.003 to 0.5, where the pH-increasing property is defined by an amount (L) of a 1.0 mol/L sodium hydroxide solution needed to increase a pH of 1 L of the acidic solution from 2.0 to 5.0.

16. The method for producing a galvanized steel sheet according to claim 10, wherein the acidic solution contains a total of 5 to 50 g/L of at least one salt selected from an acetate, a phthalate, a citrate, a succinate, a lactate, a tartrate, a borate, and a phosphate, and has a pH of 0.5 to 5.0 and a solution temperature of 20° C. to 70° C.

17. The method for producing a galvanized steel sheet according to claim 10, wherein, in the oxide layer forming step, an acidic solution coating weight on a steel sheet surface after contacting the acidic solution is 15 $g/m^2$ or less.

18. The method for producing a galvanized steel sheet according to claim 10, wherein the galvanized steel sheet is a hot-dip galvannealed steel sheet, a hot-dip galvanized steel sheet, or an electrogalvanized steel sheet.

19. The method for producing a galvanized steel sheet according to claim 10, wherein, after a steel sheet is galvanized and before the oxide layer forming step, a surface is activated by being brought into contact with an alkaline aqueous solution.

20. The method for producing a galvanized steel sheet according to claim 10, wherein, after a steel sheet is galvanized and before the oxide layer forming step, temper rolling is performed.

* * * * *